US010639809B2

(12) United States Patent
Meyer

(10) Patent No.: US 10,639,809 B2
(45) Date of Patent: May 5, 2020

(54) METHOD FOR OPERATING A DEVICE FOR CARRYING OUT CUTTING OPERATIONS ON OPEN FORMAT EDGES OF A PRINTED PRODUCT

(71) Applicant: Mueller Martini Holding AG, Hergiswil (CH)

(72) Inventor: Hanspeter Meyer, Huettwilen (CH)

(73) Assignee: MUELLER MARTINI HOLDING AG, Hergiswil (CH)

( * ) Notice: Subject to any disclaimer, the term of this patent is extended or adjusted under 35 U.S.C. 154(b) by 0 days.

(21) Appl. No.: 15/133,239

(22) Filed: Apr. 20, 2016

(65) Prior Publication Data

US 2016/0311126 A1 Oct. 27, 2016

(30) Foreign Application Priority Data

Apr. 21, 2015 (CH) ..... 0549/15

(51) Int. Cl.
*B26D 1/09* (2006.01)
*B26D 7/06* (2006.01)
(Continued)

(52) U.S. Cl.
CPC ..... *B26D 1/09* (2013.01); *B26D 7/025* (2013.01); *B26D 7/0633* (2013.01);
(Continued)

(58) Field of Classification Search
CPC .. B26D 2007/0081; B65H 2301/44712; B42C 19/08
(Continued)

(56) References Cited

U.S. PATENT DOCUMENTS 3,570,350 A * 3/1971 Fogg ..... B26D 3/08 83/404
3,722,336 A * 3/1973 Sarring ..... B26D 7/0625 83/155
(Continued)

FOREIGN PATENT DOCUMENTS

CH 456533 A 7/1968
CN 106064401 A 11/2016
(Continued)

OTHER PUBLICATIONS

U.S. Appl. No. 15/133,238, filed Jun. 5, 1946, status pending.
U.S. Pat. No. 5,957,449, Grapha Holding AG, dated Sep. 28, 1999.

*Primary Examiner* — Kenneth E Peterson
(74) *Attorney, Agent, or Firm* — Leydig, Voit & Mayer, Ltd.

(57) ABSTRACT

A method is for operating a device for carrying out cutting operations on an open format edge of a printed product. The device is operatively connected to a feed apparatus for the first cutting operation and to a removal apparatus which operates after the final cutting operation. The printed product is transferred from a first cutting location, at which the cutting operation for a first format edge is carried out, to a second cutting location, at which the cutting operation for a second format edge takes place. Once the cutting operation is complete at the second cutting location, the printed product is transferred to a third cutting location, at which the cutting operation for a third format edge takes place. The printed product is transferred among the cutting locations by a transport unit that grips the printed product by the spine to convey the product in a suspended manner.

20 Claims, 10 Drawing Sheets

(51) Int. Cl.
*B26D 7/02* (2006.01)
*B26D 11/00* (2006.01)
*B26D 7/00* (2006.01)

(52) U.S. Cl.
CPC ..... *B26D 7/0675* (2013.01); *B26D 11/00* (2013.01); *B26D 2007/0056* (2013.01); *B26D 2007/0081* (2013.01); *B65H 2301/44714* (2013.01)

(58) Field of Classification Search
USPC ..... 83/934, 206, 207
See application file for complete search history.

(56) References Cited

U.S. PATENT DOCUMENTS 3,822,626 A * 7/1974 Aspinwall ..... B23C 3/00 83/404.4
5,113,731 A * 5/1992 Reist ..... B26D 1/20 83/35
5,715,737 A * 2/1998 Stauber ..... B26D 7/0675 83/154
5,950,511 A * 9/1999 Luthi ..... B26D 7/0675 83/154
6,270,076 B1 * 8/2001 Reist ..... B65H 29/003 271/204
6,506,008 B2 * 1/2003 Merkli ..... B26D 1/09 270/52.17
6,516,695 B2 * 2/2003 Cassoni ..... B26D 7/0675 83/213
7,533,596 B2 * 5/2009 Rathert ..... B26D 7/025 83/404.1
8,245,611 B2 * 8/2012 Mockli ..... B26D 1/43 270/52.18
9,808,949 B2 * 11/2017 Hori ..... B26D 1/08
10,059,014 B2 * 8/2018 Scheid ..... B26D 1/09
2003/0041712 A1 3/2003 Tsuruta
2003/0145703 A1 * 8/2003 Rohe-Krebeck ..... B26D 7/015 83/277
2005/0061133 A1 3/2005 Marbacher
2010/0278617 A1 * 11/2010 Sano ..... B26D 1/08 412/16

FOREIGN PATENT DOCUMENTS

DE 19515705 C1 10/1996
DE 102011105253 A1 12/2012
EP 1504860 A1 2/2005
GB 834667 A * 5/1960 ..... B26D 1/06
JP 2012-218114 A * 11/2012
JP 2012218114 A 11/2012
JP 2016-124221 * 7/2016 ..... B42C 19/08

* cited by examiner

METHOD FOR OPERATING A DEVICE FOR CARRYING OUT CUTTING OPERATIONS ON OPEN FORMAT EDGES OF A PRINTED PRODUCT

CROSS-REFERENCE TO PRIOR APPLICATION

Priority is claimed to Swiss Patent Application No. CH 00549/15, filed on Apr. 21, 2015, the entire disclosure of which is hereby incorporated by reference herein.

FIELD

The present invention relates to a method for operating a device for carrying out cutting operations on open format edges of at least one printed product, specifically for trimming at least one head edge, front edge or foot edge.

The term "open format edges" is thus understood to include head parts, front parts and foot parts of the printed product, regardless of whether said product is composed of individual pages or signatures.

To industrially produce printed products, preferably book blocks or booklets, in small or very small print runs, a three-knife trimmer is used, which is capable of cutting products having the same or variable formats and thicknesses to the desired formats, one after the other with high cycle output and an extremely high-quality cut.

In three cutting stations, the book blocks or booklets of a predetermined thickness are cut to the final format at the head side, foot side and front side. The book blocks or booklets have a binding on the spine. Any known method can be considered for the binding, e.g. thread-stitching, perfect binding, gathering-stitching, etc.

The three-knife trimmer is thus intended to be usable as both a solo machine and a machine in a line assembly with other manufacturing machines.

BACKGROUND

The device, referred to hereinafter as the three-knife trimmer, is responsible for cutting the provided printed products, i.e. mostly book blocks and/or booklets, on the three open sides. This is carried out by the book block or the booklet (referred to hereinafter only as book block) being clamped, when stationary, between pressure bars or pressure plates and three cutting apparatuses trimming the three aforementioned sides of the book block. The cutting apparatuses can be in the form of counter blade units, in which two blades cut relative to one another like scissors, or as blade units having cutting bars, in which a blade cuts against a plastics bar and slightly penetrates the plastics bar when in the final position.

In three-knife trimmers of this type, the head and foot are generally cut in a first phase and the front in a second phase. However, this order is not compulsory and can also be the other way around. It is also possible for only the head and foot or only the front to be cut on the book block, as is required for example for the production of English booklets. There are three-knife trimmer designs in which the book block remains stationary between the first cutting phase (e.g. head and foot cut) and the second cutting phase (e.g. front cut), and there are designs in which the book block is transported between said phases.

Three-knife trimmers are known in which, for the cutting, the book blocks are pressed and held between press rams and cutting cartridges. When the press ram is raised, the cut book block is conveyed away and the book block to be cut next is introduced. The book block is moved into position by a centring device and then clamped by the press ram travelling therebelow. The blades move against the book in a swinging cut and cut the open sides. Once all the sides have been cut, the press ram is raised and the next work cycle can begin. This three-knife trimmer design is not capable of a quick format change. The press ram and the cutting cartridge are tailored to the format to be processed and can only be exchanged by stopping the machine.

DE 10 2011 105 253 A1 discloses a three-knife trimmer in which the blades cut against cutting bars or counter blades, the book block being held next to the blades by pressure bars when the head, foot and front are cut. In the gap between the cutting bars or counter blades on the one hand, which gap varies depending on the format, and the space between the pressure bars on the other, there is arranged a plurality of zigzag support ribs for supporting the book block during the cutting. By means of a three-knife trimmer of this type, good quality cutting can be achieved because the book block is pressed or supported by the pressure bars and the zigzag support ribs during the cutting.

However, it has to be borne in mind with this solution that the book block can get caught on the zigzag support ribs when being conveyed into and out of the cutting position. This fact is counteracted in DE 10 2011 105 253 A1 by the transport system consisting of a lower belt and an upper belt, the two belts for transporting the book block being driven more or less together relative to one another so that the book block cannot get caught on the support ribs of the bed plane or pressing plane. However, when the book block is transported thus, only one book block can ever be transported in the transport system if the book blocks have different thicknesses. This limits the permissible thickness difference from book block to book block since there is a plurality of book blocks in the transport system. In particular, in three-knife trimmers, in which the cutting is carried out in two stations, problems arise when using the described transport system to transport the book blocks that vary greatly in thickness. In the case of book blocks that vary greatly in thickness, it is thus necessary to only ever transport one book block within the transport system. In such a three-knife trimmer, however, this limits the capacity, i.e. the three-knife trimmer can only be operated with a low number of cycles (low output).

DE 10 2011 105 253 A1 sets out further three-knife trimmers that define prior art. None of them, however, makes it possible to satisfy the requirements of low changeover time combined with the requirement of high cut quality.

EP 1 504 860 A1 discloses a three-knife trimmer in which the book blocks to be trimmed are gripped by a positioning device and supplied to the cutting apparatuses by a feed apparatus. A plurality of spaced-apart cutting apparatuses are provided, in which the book blocks are positioned one behind the other by the feed apparatus for a side cut in each case. In each cutting apparatus, a side cut is carried out on the positioned printed product. The oriented book blocks are moved from the positioning apparatus into a transition position by an intake gripper by means of a linear stroke, the orientation of the book blocks not being changed. The book blocks are fed by a multiple epicyclical gearing. To position the book blocks in the cutting apparatuses, adjustable control links are provided. The device allows for simple and quick changeover to different formats. Each cutting apparatus consists of a lower blade fixed to the frame, and an upper blade to which a pressure plate is coupled by means of a guide and a pneumatic cylinder. Prior to the cutting, the pressure plate clamps the bookblock between the pressure plate and the stationary lower blade. In the process, the bookblock is not pressed by the pressure plate, the lower blade and the feed apparatus over a large surface area, but rather just in the cutting region. The regions of the book block that are not pressed tend to "sag" and can thus lead to an unsatisfactory cut quality. This is the case in particular when soft and/or thin paper is used for the book blocks.

JP 2012-218114 A discloses a three-knife trimmer which can process different book formats one after the other and in which the outer sides of the book are not damaged. A mounting unit for gripping the rear side of the printed product is attached to a moving part, the mounting unit comprising a reference surface for positioning the spine of the printed product. By means of a positioning actuator, the moving part is moved in a vertical plane by a controller and positioned, in each case in the correct manner for the format, on the three open sides of the printed product for the cutting processes so that the cutting blades moving in the horizontal direction can cut the printed product. The printed product is oriented on the reference surface of the mounting unit and on a vertical bearing surface, which allows the controller, together with the format data, to approach the positions required for each cut and to position the printed product correctly for the cutting.

The disadvantage of this three-knife trimmer is the limited possibility of varying the book format. Since the one mounting unit holds the printed product for all three cuts, the mounting unit has to be significantly smaller than the smallest printed product to be processed. If the printed product has a significantly larger format, the plates that are also used for supporting the printed product during the cutting have to be additionally provided with a large recessed region. However, a large recessed region has a negative effect on the cut quality.

For the front cut, the mounting unit can enter the recessed region of the plates to a greater or lesser extent. The printed product is then only properly supported when the mounting unit is inserted far into the recessed region of the plates. So that the printed product can be sufficiently supported without exchanging the plates, the three-knife trimmer can only be used to process books with a small difference in width.

SUMMARY

In an embodiment, the present invention provides a method for operating a device for carrying out cutting operations on at least one open format edge of at least one printed product. The device is operatively connected to a printed product-based feed apparatus for the first cutting operation and to a printed product-based removal apparatus, which operates after the final cutting operation. Each edge-based cutting operation is carried out using at least one cutting apparatus. The printed product is transferred from a first cutting location, at which the cutting operation for a first format edge of the printed product is carried out, to a second cutting location, at which the cutting operation for a second format edge takes place. Once the cutting operation is complete at the second cutting location, the printed product is transferred to a third cutting location, at which the cutting operation for a third format edge takes place. The printed product is transferred from one cutting location to the next by at least one transport unit comprising at least one device that grips the printed product by the spine in order to convey the product from one cutting location to the next in a suspended manner.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
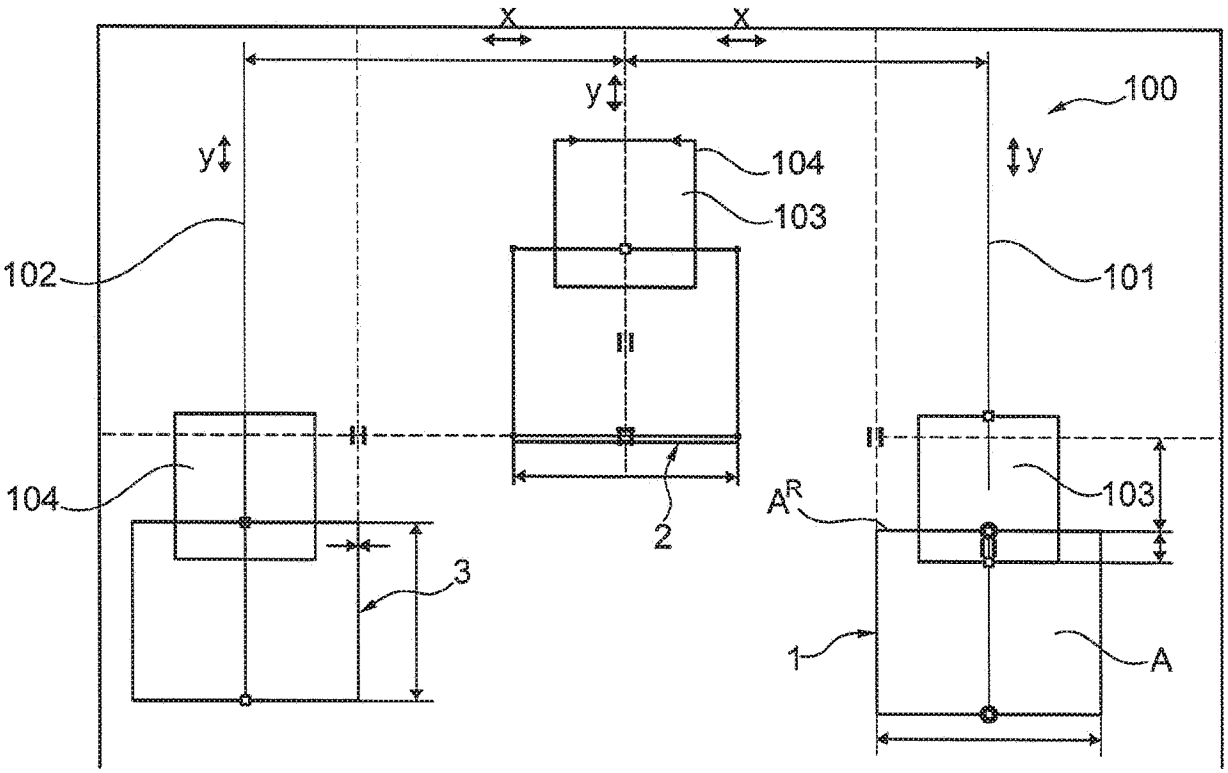
FIG. 1 shows translational movements of the supports and grippers within the X-plane and Y-plane.

In an embodiment, the present invention provides a method for operating a device in the form of a three-knife trimmer that is capable of continuously processing printed products of the same or different formats and thicknesses, i.e. to trim said products to a defined format, while having a high cutting output and cut quality. The three-knife trimmer according to an embodiment of the invention and the operation thereof is also capable of trimming stacked booklets following the same approach as with a book block.

The three-knife trimmer is thus used for trimming open format edges, also referred to as side edges of printed products, e.g. books, booklets, magazines, the term "printed product" predominantly being used hereinafter for the sake of simplicity, "book block" or "booklet" being used at some points.

By means of the three-knife trimmer according to an embodiment of the invention and the operation thereof, the smallest runs can be processed reliably, down to a minimum count of one, without having to plan for machine downtimes owing to a changeover from one format to the next. In this way, book block formats of various sizes can be supplied to the three-knife trimmer and/or it is possible to process the production of book blocks by means of different portions to be trimmed at the edges.

In accordance with an embodiment, the invention is achieved by a method in which the printed product is transferred from a first cutting location, at which the cutting operation for a first side edge takes place, to a second cutting location, at which the cutting operation for a second side edge takes place, wherein, once the cutting operation is complete at the second cutting location, the printed product is supplied to a third cutting location, at which the cutting operation for a third side edge takes place, wherein the printed product is transferred from one cutting location to the next by means of at least one transport unit.

To maintain high efficiency of the three-knife trimmer according to the invention during operation, the format changeover takes place while the machine is running, preferably during the period of time that is available for the printed product to be transported in and out.

In the process, the changeover from one format to the next has to take place with high precision so that each cut printed product meets the requirements in terms of its dimensional accuracy.

Since the operation according to an embodiment of the invention of the three-knife trimmer can even be used with a print run of just one copy, the aim of an embodiment of the invention has to be considered that of reliably cutting the copy provided just once 100% of the time.

Another significant advantage of an embodiment of the invention can be considered to be that the three-knife trimmer has a simple design and is operated in a functionally reliable manner, so it can be operated even by temporary staff.

By means of the method according to an embodiment of the invention, during operation of the three-knife trimmer it is ensured that the dimensional accuracy of the cut printed product and the straight, parallel and rectangular cuts thereof with respect to the front and rear faces of each printed product are guaranteed.

During operation of the three-knife trimmer, the method according to an embodiment of the invention thus ensures high cut quality, even in the case of relatively large printed product thicknesses, since the printed product is clamped to a maximum across its whole surface area between the first and last page by at least one clamping apparatus while the cutting operations take place at the pending open side edges, and so in this cutting operation it is possible to eliminate the risk of "sags", which are detrimental to quality. The gripping over the entire surface area of the printed product can be achieved as necessary by a plurality of pressure plates or for example by segmented pressure plates or individually operated pressure elements.

In the process, the printed products are supplied to the three-knife trimmer in a horizontal position by means of a conveyor belt, with the spine, bound according to any method, ahead and at an approximately identical distance from one another. The approximately equal distance is either produced by the printed products being supplied to the conveyor belt of the three-knife trimmer in a clocked manner, or a supply of this type is generated by devices and methods known per se upstream of the conveyor belt.

In another embodiment, the printed products are supplied to the conveyor belt of the three-knife trimmer at an irregular distance from one another. A clock apparatus ensures that the distances (spacing between the leading book spine edge and the book spine edge of the following product) do not drop below minimum distances. A sensor detects when the printed product arrives at the conveyor belt of the three-knife trimmer.

As a first preferred variant, if the spacing between the printed products is now greater than the minimum distance, the printed products within the three-knife trimmer process can be completely finished and the feeding can be restarted afterwards. As another option, the speed of the three-knife trimmer can be reduced by the controller and the three-knife trimmer can be synchronised with the cycle of the printed product. If the distance exceeds a maximum value, the controller can also optionally generate empty cycles on the three-knife trimmer.

The transport unit consists substantially of at least one support that is equipped on its end with at least one printed product-based gripper, the gripper gripping the book spine of the printed product to be trimmed, and the support/gripper being based on the following controller-assisted, translational movements with respect to the cutting locations:

Taking the printed product by means of the gripper of the support following the end of the first cutting operation at the first cutting location.

Transferring said printed product by means of the same support/gripper to the second cutting location following the cutting operation at the first cutting location.

Transferring the same printed product by means of the same support/gripper to the third cutting location for the third cutting operation following the cutting operation at the second cutting location, and then Returning the support/gripper to the starting position to take a subsequently delivered printed product again once the first cutting operation at the first cutting location has finished.

The transport unit can also consist of two printed product-based supports, which each have a gripper that also grips the book spine of the printed product to be trimmed, wherein said supports having the associated grippers are operatively interconnected, and the supports and grippers being based on the following controller-assisted, translational movements with respect to the cutting locations:

The first gripper of the first support takes the printed product once the first cutting operation is complete at the first cutting location.

The first support/gripper transfers said printed product to the second cutting location where it positions the printed product for the second cutting operation to be carried out, and then travels back to the starting position at the first cutting location, where a subsequently delivered printed product is taken again once the first cutting operation has been carried out thereon at the first cutting location.

In the meantime, the second gripper of the second support takes the printed product immediately after the end of the cutting operation at the second cutting location, and transfers it to the third cutting location, where the third cutting operation takes place.

Afterwards, the second support having the second gripper returns to the second cutting location where there is already an already-trimmed printed product brought subsequently by the first support/gripper, which product is then transferred to the third cutting location.

During operation with both one support and two supports, generally, the head part is trimmed at the first cutting location, the front part is trimmed at the second cutting location and the foot part of the printed product is trimmed at the third cutting location.

In the three-knife trimmer per se, this method sequence is not necessarily set, in particular with regard to the processing order of the first and third cutting location, according to which the head part always has to be trimmed first, but instead it is quite possible to process the foot part at the first cutting location and then the head part at the third cutting location, the front part of the printed product still being trimmed at the second cutting location in order to design the translational movements on which an embodiment of the invention is based in an optimum manner according to the sequence.

Whether the head part or foot part is processed at the first cutting location depends on how the supply of the printed product to the three-knife trimmer is arranged, i.e. whether the front page of the printed product faces up or down on the conveyor belt. In both cases, the spine edge of the printed product remains at the front during transportation to the three-knife trimmer. If a swap of this type (head part/foot part) is carried out, it has to be ensured that corresponding control arrangements are made for the portions to be trimmed off, in particular if head and foot parts having different trimming lengths are to be processed.

The translational movements of the gripper(s) thus cover two or three work planes, respectively, specifically:

- a first plane (X) which is characterised by transferring the printed product from one cutting location to the next;
- a second plane (Y) which is characterised by loading and unloading the printed product at the respective cutting locations;
- a third plane (Z) which is characterised by a lateral adjustment (offset movement) of the support/gripper relative to the stationary, printed product-based clamping apparatuses at the cutting location, this lateral adjustment being predefined or optionally being able to be used in a controlled manner.

The gripper itself is equipped on its ends with printed product-based clamping jaws, said gripper or the support(s) having an additional translational degree of freedom in all the aforementioned planes (X, Y, Z) at the cutting locations. In the process, each printed product is gripped to a maximum at its centre of gravity, and/or the gripping of the printed product coincides with the best possible geometric location according to the portions to be trimmed off at the open side edges (head, front, foot), it being possible in this latter option to have a moderate to sharp deviation from the theoretical centre of gravity of the printed product.

The cutting stations of the three-knife trimmer are operatively connected to at least one stationary, semi-stationary or movable force-exerting clamping apparatus that is responsible for the basic gripping and generation of the pressure force on the printed product to be trimmed, said clamping apparatus being tailored to the format size of the printed product, i.e. comprising an optimised fixed pressing surface, or being adjustable to the respective format sizes of the printed product during operation by means of simultaneous adaptations.

The force exertion, i.e. the pressure force to be applied, of a clamping apparatus of this type on the printed product during the cutting operation acts on the printed product predominantly, in terms of the forces, counter to the closure force to be exerted by the clamping jaws of the gripper, in such a way that said product remains in a fixed position during the entire cutting operation as a result of the pressure force emanating from the particular clamping apparatus.

Where the closure force of the clamping jaws of the gripper remains at the location of the cutting operation, the pressure force of the clamping apparatus and the vectors thereof do not influence the printed product. This means that, in terms of effect and force, the pressure force of the clamping apparatus is in absolute terms predominant over the closure force of the clamping jaws of the gripper.

At least one clamping apparatus within the three-knife trimmer can consist of two clamping plates, which perform at least one force-exerting closure movement relative to one another. In addition, at a suitable cutting location, at least one further clamping apparatus can consist of individual interconnected pressure bars, which exert the pressure force on the pressure surfaces of the printed product, said pressure bars together forming a pressure bar group.

According to an embodiment of the invention, a feed apparatus (also referred to as an insertion wheel or star-shaped wheel owing to its design) is first directly operatively linked, in a manner specific to the method, to the first cutting operation at the first cutting location. In principle, this feed apparatus is multi-part, preferably in the form of a four-part wheel, it also being possible to divide said wheel differently. If a bound book block is to be conveyed, a multi-part feed apparatus of this type operates as follows:

During a first 90° rotation of the feed apparatus, a hinged rake-like guide is pivoted against the book block in such a manner that, following the 90° rotation, the book block rests on the spine and is protected against fanning out and/or tipping over. The rake-like guide is coupled to a clamping assembly, which operates within the feed apparatus and briefly clamps the book block in a position resting on the spine. Said clamping assembly is kinematically designed such that the rake-like guide is transferred into a position dependent on the book block thickness. In this position, the clamping assembly opens slightly, and so the book block orients itself, as a result of gravity, on its spine against a stop surface within the corresponding station of the feed apparatus. The clamping assembly then closes again, after which the book block is held in a defined position for the additional processes.

Next, the feed apparatus, i.e. the insertion wheel, rotates further by two 90° cycles in each case and moves the book block into a now suspended position. During this rotational movement, the first rake-like guide and an operatively connected second guide are pivoted away from the book block in such a manner that the free sides or signatures of the book block hang vertically downwards as a result of gravity alone, while the book block is held in the region of its spine by said clamping assembly.

The method for operating the feed apparatus of the device according to an embodiment of the invention for printed products consisting of one or more booklets can also be formed by a multi-part feed apparatus of this type, this feed apparatus then operating as follows:

During a first 90° rotation of the feed apparatus, a hinged rake-like guide is pivoted against the booklets in such a manner that, following the 90° rotation, the booklets rest on their spine and are protected against fanning out and/or tipping over. The rake-like guide is coupled to a clamping assembly that operates within the feed device and briefly clamps the booklets in a position resting on the spine, said clamping assembly being kinematically designed such that the rake-like guide can be transferred into a position dependent on the thickness. After, the clamping assembly opens again slightly, and so the booklets orient themselves, as a result of gravity, on their spines against a stop surface within the feed apparatus and/or during this process additional mechanical and/or vibration-triggering means intervene and orient the booklets to form a block having a uniform format. The clamping assembly then closes again, after which the booklets are held in a defined position.

Next, the feed apparatus rotates further by two 90° cycles in each case and moves the booklets into a now suspended position. During this rotational movement, the first rake-like guide and an operatively connected second guide are pivoted away from the booklets, and so the free sides or signatures of the booklets hang vertically downwards as a result of gravity alone, while the booklets are held by the clamping assembly in the region of their spine.

On the other hand, said feed apparatus is operatively connected, in the region of the first cutting location, to a movable transport clamp equipped with clamping plates, which clamp carries out the function of the clamping apparatus and takes the printed product from the feed apparatus in accordance with the above-described kinematics and supplies said product to the first cutting operation.

A leveller slide is operatively connected to the feed apparatus and is intended to be used in addition to the measures explained above to ensure secure positioning of the book block with respect to the stop surfaces thereof.

With both individual books and a stack of booklets, a stop surface is taken as the basis for the orientation, according to the spine side of the printed products, with respect to a fixed bearing surface inside the feed apparatus. On the other hand, it has to be ensured that, prior to the first cutting operation, the printed products have a corresponding suspended oblong position in the flow direction at the head side and/or the foot side.

In the case of individual books, this takes place in that the individual book is taken, according to the format, from the feed apparatus by the transport clamping apparatus in a manner controlled by a sensor, which is oriented towards the outer edge of the overhanging cover or of the book block in the region of the head part or foot part, respectively. This ensures that the sliver cut off at that point on the book block has a coordinated size.

In the case of a stacked bundle of individual booklets, lateral means, preferably additional leveller slides that ensure uniform horizontal orientation of the cutting-location-side edges of said bundle are provided before the first cutting operation.

In summary, the feed apparatus thus operates by a hinged, rake-like guide pivoting against the printed product so that, following a 90° rotation, said product, now resting on its spine, cannot fan out or tip over. The rake-like guide is coupled to a clamping assembly, which briefly clamps the printed product in a position resting on the spine and is kinematically designed such that said rake-like guide can be transferred into a position dependent on the thickness. Subsequently, the clamping assembly opens again slightly so that the spine of the printed product can orient itself, as a result of gravity, according to the stop surface of the feed apparatus. The clamping assembly then closes again, after which the printed product is held in a defined position.

This approach, which is optimised per se, thus ensures that the spine sides of the printed products assume a defined position that is critical for the subsequent cutting operations.

Nevertheless, for reasons of quality it is appropriate to provide additional measures (leveller slides, which act in the vertical and horizontal direction of the printed product) that are intended to intervene in those cases where it is not sufficient, when the printed products have different designs, in particular in terms of the spine, to use gravity alone to generally guarantee the desired defined position of the printed product with respect to the associated stop surface.

In this context, it must be assumed that the printed products, in particular the book blocks, are in most cases configured to have a cover that has a relatively large overhang on all sides (head, foot, front part) with respect to the enclosed body. Said overhang in principle does not restrict the cutting process in any way, yet has to be detected by additional sensors during the various cutting operations to ensure precise trimming of the printed product. Owing to logistical aspects, cover sizes that are as identical as possible are advantageously used, whereby a large spectrum of different book block formats can be gripped. It can also be assumed that a relatively large overhang is used in the majority of cases.

To achieve the secure defined position between the book block spine side and stop surface within the feed apparatus even in the case of covers having a large overhang in the region of the head, foot and front parts, i.e. to grip in the manner specific to the method, an embodiment of the invention to makes one significant contribution over the prior art in that it is proposed that, during the brief time the clamping assembly is open to make use of gravity on the printed product, at least one suitable leveller slide is additionally used, as mentioned above, which can directly or indirectly exert the necessary contact pressure on the enclosed printed product by means of the cover overhangs so that at least the spine side of the printed product rests securely on the associated stop surface.

For this purpose, the two front cover overhangs of the book block are gripped by a system of brush combs oriented at an optimum angle in the pressing plane or by other flexible mechanically or pneumatically actuated means, and so the resultant contact pressure can be transmitted to the body of the printed product via cover overhangs in such a manner that said product then rests securely on the stop surface arranged within the feed apparatus.

With the example of a brush comb, the material flexibility thereof is selected such that the resulting free portion of the brush comb between the two cover overhangs can additionally advance as far as to the front part of the book block as a result of the vertical or semi-vertical pressing movement, in order to be able to exert an additional or predominant contact pressure at that point.

In principle, this approach can also be provided in the case of a lateral contact pressure, by suitable means, on the head part or foot part of the printed product to form a uniform plane, and also when the bundle consists of different booklets, so that said uniform edge of the printed product is then recorded by a sensor and the cutting operations can then be controlled accordingly.

According to an embodiment of the invention and as mentioned above, the clamping apparatus at the second cutting location involves operation by means of pressure bars that are arranged on both sides of the pressure surfaces of the printed product and press the printed product simultaneously or one after the other at least from one side.

The number of pressure bars used during operation on both sides is set and controlled in each case depending on the format size of the printed product to be processed, the pressure bars put into operation for exerting the pressure force on the printed product also being able to perform movements in opposite directions, either with the same force or by a controlled, gradual force application, with the same or different movement profiles.

If the pressure bars act on the printed product one after the other, the pressure effect, i.e. the pressure force application, begins with the first pressure bar in the region of the spine of the printed product, in order to then proceed continuously almost up to the region of the edge to be cut, by means of a subsequent or semi-subsequent sequence.

Actuating the pressure bars one after the other along the format of the printed product also means that the air trapped between the pages or signatures of the printed product is also continuously pressed out until a complete thickness consistency of the block is achieved. Only then can the cutting operations, in particular those aimed at the front edge of the printed product, be successfully carried out. This approach can also be carried out in the other cutting operations using corresponding clamping apparatuses.

Regardless of which type of clamping apparatus is used, whether based on clamping plates or pressure bars, owing to the use of pressure beams the printed product is additionally pressed at the ends in the immediate region of the cutting operations, whereby optimum final conditions are achieved for the cutting operation.

In the region of the third cutting operation at the third cutting location, an additional force-exerting clamping apparatus is used, which is constructed according to a four-clamp system, said system also being able to be divided differently. To prevent any linguistic conflicts with respect to the aforementioned clamping apparatuses, a four-clamp system is referred to in the following. Said four-clamp system can at the same time, either directly or indirectly, carry out the function of a printed product-based removal apparatus.

During operation according to the method of the three-knife trimmer, said four-clamp system, which can receive both book blocks and booklets and can provide the further processing, is operated according to the following criteria:

During the cutting process at the third cutting location, the book blocks or booklets introduced into the four-clamp system for the third cutting operation are pressed between a movable clamping jaw belonging to the four-clamp system and a stationary clamping jaw.

Following the cutting operation at said third cutting location, the rotatable four-clamp system rotates by 90° during each cycle and thus one bracket having the book block or the booklets also moves away from the blade orthogonally to the blade movement at the third cutting location. In this position, the book block or the booklets are conveyed out of the four-clamp system and transferred to a conveyor belt.

In terms of the trimming of the individual open side edges of the printed product, the cutting operations at the cutting locations of the three-knife trimmer are carried out using one individually driven cutting apparatus in each case, at least one cutting apparatus being operated with a single-action cutting blade.

Said cutting apparatus is preferably modular and consists of at least three cutting stations for trimming the head, front and foot edge, which cutting stations are U-shaped and arranged with the open side downwards. The operation of the cutting operations is thus operatively linked with at least one locally arranged pressure beam in each case, the pressure beam acting against the inner planes of the U-shape. By means of this U-shaped configuration, all the cut portions of the book block or booklets fall downwards.

In addition, the operation of the three-knife trimmer according to the invention has the following advantages over the known three-knife trimmers:

During the individual cutting operations, the printed product is in clamping apparatuses (clamping plates or pressure bar groups) formed at several points, with the additional pressing action from the above-mentioned pressure beams, and so the printed product is gripped over almost the entire surface thereof during each cutting operation. The printed product is only not gripped in the region of the spine. This is unimportant because the spine binding used in each case (thread-stitching, perfect binding, gathering-stitching, etc.) holds the printed product together sufficiently in this region, while the clamping plates or pressure bars used integrally support the printed product to a sufficient extent. This full-surface pressing of the printed product in connection with the pressure beams used are the prerequisites for a high cut quality.

Therefore, the pressing according to the invention over almost the entire surface of the printed product is achieved in an extremely simple manner. There is no need to provide any format-dependent ribs, supporting elements or support bars. As a result, high output with high cycle counts can be achieved during operation of the three-knife trimmer according to the invention.

Since the printed product is transported in a suspended manner to the individual cutting stations of the cutting apparatus by the operation of the three-knife trimmer according to the invention, there is no need for any supports for the pages of the printed product at the transition points in the transport system.

Since the printed products are thus not transported horizontally, the pages of the books do not sag either between the bearing points if the bearing surfaces are not over the entire surface area, and thus they cannot become caught at the intended transition points.

The three cutting stations of the cutting apparatus are U-shaped and have the open side of the U directed downwards. The length to be trimmed off at the edges, i.e. at the open sides, of the printed product takes place against the inside of the U-shape in all three cutting operations (head, foot, front part). As a result, one single removal device can be used, whereby all the accumulating cut-offs can be "conveyed away" together. The cut-offs fall downwards by means of gravity, without any auxiliary means, where they can be collected together or continuously transported away.

Effective removal of cut-offs is therefore very important because, in industrial production of individual printed products (book blocks), the different formats are very often produced first at the three-knife trimmer. In the process, the printed products are supplied to the three-knife trimmer at a size that is tailored to the largest final format, which naturally leads to large portions to be trimmed off in the case of small final formats.

In three-knife trimmers having cutting cartridges and press rams, it is common to orient the printed product from the book spine towards the head side and from the book spine towards the foot side by means of two rectangular stops in the corners, and from the book block front side by one stop. When producing variable-format printed products (book blocks), covers of the same format are often used for a particular format range.

If the thickness of the printed products now varies within a particular scope and said products are produced by fixed-edge processing, the cover at the top side of the printed product does not protrude to the same extent as at the last page thereof. If the printed product height varies, the cover protrudes from the printed product to a greater or lesser extent depending on the circumstances. Generally, the printed products are produced having a fixed projecting length of the cover on one side and a variable projecting length on the other side. In products of this type, the orientation of the book block is unsuitable, as with the three-knife trimmers having cutting cartridges and press rams.

By contrast, during operation of the three-knife trimmer according to the invention, the as yet uncut printed product is oriented at the foot or head edge and the spine edge. Therefore, the variable projecting lengths of the width (if need be also height) of the cover of the printed product are insignificant.

For each printed product to be cut, the three-knife trimmer controller has to know product data from which the necessary movements of the transport members can be calculated so that a cut printed product having the desired format dimensions is produced at the end.

In this case, these data can be transmitted to the controller in many different ways. A few options are set out below by way of example:

Each printed product is equipped with an identification feature. A feature reader at the input of the three-knife trimmer reads the identification feature (e.g. 1-D or 2-D barcode, RFID chip, label, image, etc.) and transmits the information from the feature to the controller together with the machine cycle assignment. The feature can contain the necessary pieces of information that depict the cut printed product dimensions, or the missing information can be added from control profiles stored in a database.

In another system, the printed products are supplied to the three-knife trimmer in a clocked manner. With each cycle, the three-knife trimmer controller is supplied with the information that is required for cutting the printed product to the correct dimension. In this case too, data supplied with the printed product can be completed by data from a database.

Another option is that the data containing an order of the printed products is communicated to the three-knife trimmer before said printed products are supplied. With each printed product supplied, the three-knife trimmer processes the next dataset in the predetermined order. In the process, the printed products have to be supplied in the correct order. For monitoring purposes, a feature reader that monitors the order can additionally be used.

As mentioned above, the printed products are supplied horizontally to the three-knife trimmer by means of a conveyor belt, with the processed side (thread-stitching, perfect binding, gathering-stitching, etc.) at the front and at an approximately equal distance from one another. The approximately equal distance is either produced by the printed products being supplied to the conveyor belt of the three-knife trimmer in a clocked manner, or it is generated by devices and methods known from the prior art upstream of the conveyor belt.

In another embodiment, the printed products are supplied to the conveyor belt of the three-knife trimmer at an irregular distance from one another. A clock apparatus ensures that the distances (spacing from book spine edge to the book spine edge of the next product) do not drop below minimum distances. A sensor detects when a book block arrives at the conveyor belt of the three-knife trimmer. As a first preferred variant, if the spacing between the book blocks is now greater than the minimum distance, the printed products within the three-knife trimmer process can be completely finished and the feeding can be restarted afterwards.

As another option, the speed of the three-knife trimmer can be reduced by the controller and the three-knife trimmer can be synchronised with the cycle of the printed product. If the distance exceeds a maximum value, the controller can optionally also generate empty cycles on the three-knife trimmer, as has already been described above in relation to the operation of the feed apparatus.

The invention will be described in greater detail below with reference to the drawings. All of the elements which are not essential for the immediate comprehension of the invention have been omitted. In the following, the printed product is referred to generally as a book block, whereby space is also given to the discussion of other types of printed product, for example booklets.

FIG. 1 is a schematic view of the translational movements of a transport unit belonging to a three-knife trimmer 100, the movements of which unit are performed from two movable, printed product-based supports 101, 102, said supports being operatively interconnected, as will be described in more detail in the description of the other figures. On their ends, the supports comprise printed product-based grippers 103, 104 that comprise clamping jaws and grip one after the other the spine $A^R$ of the printed product A to be trimmed. With respect to the cutting locations 1, 2, 3, which are also referred to as cutting stations, the supports themselves perform the following coordinated, controller-assisted translational movements:

The first support 101 actively takes the printed product A once the first cutting operation at the first cutting location 1 is complete. Then, the first support transfers said printed product A to the second cutting location 2, and returns to the starting position at the first cutting location 1 once the printed product has been deposited in order to pick up another, subsequently delivered printed product A, after the first cutting operation at the first cutting location 1 has been carried out. In the meantime, the second support 102 takes the printed product A immediately after the cutting operation at the second cutting location 2 is complete, and transfers said printed product to the third cutting location 3, where the third cutting operation takes place. Afterwards, the second support 102 returns to the second cutting location 2, where another, already trimmed printed product A provided by the first support is already standing by to be picked up and transferred to the third cutting location 3.

The translational movements of the supports 101, 102 having the connected grippers 103, 104 cover two or three planes, respectively. Specifically in the first plane X the printed product is transferred from one cutting location to the next; in the second plane Y the printed product is loaded and unloaded at the particular cutting location. Optionally, a third plane Z is also used, in which a lateral adjustment (offset movement) with respect to the stationary printed product-based clamping elements is carried out as required at the particular cutting location of the three-knife trimmer 100.

In the following, the action of the translational movements of the supports will be described based on the grippers since it is these that best depict the operations of the three-knife trimmer.

Figure 2:
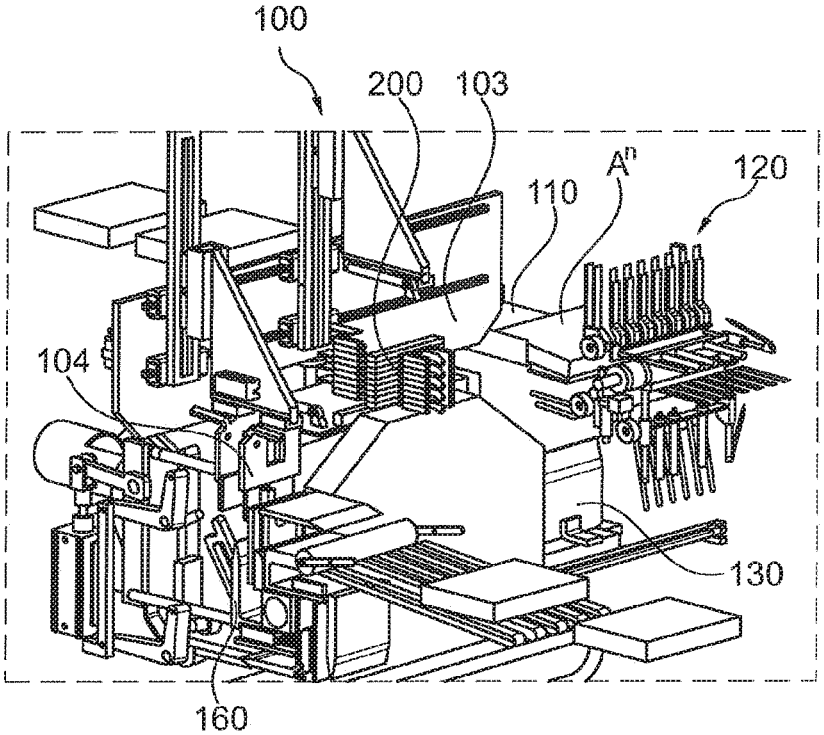
FIG. 2 is an overall view of the three-knife trimmer, showing the supports.
Figure 3:
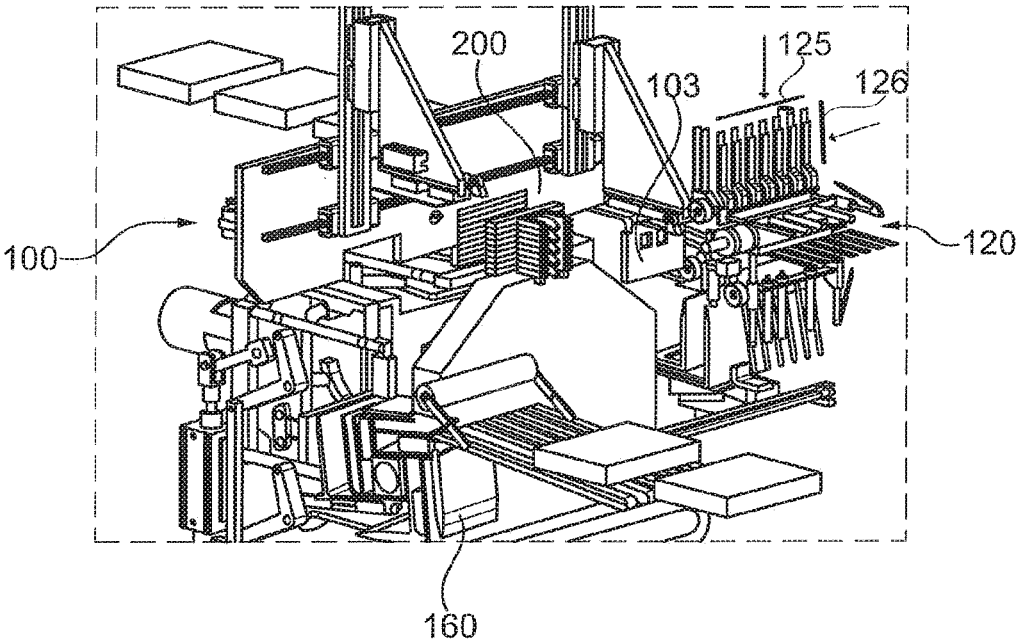
FIG. 3 is an additional view of the three-knife trimmer, again showing the supports.

FIGS. 2 and 3 are 3-D views of the three-knife trimmer 100. The book blocks $A^n$ are supplied to the three-knife trimmer 100 in a horizontal position by means of a conveyor belt 110, with the book block spine at the front and at an approximately equal distance from one another. The approximately equal distance is either produced by the book blocks being supplied to the conveyor belt of the three-knife trimmer in a clocked manner, or it is generated by devices known from the prior art upstream of the conveyor belt.

In another embodiment, the book blocks are supplied to the conveyor belt 110 of the three-knife trimmer 100 at an irregular distance from one another. A clock apparatus ensures that the distances (spacing from a leading book spine edge to the book spine edge of the next book block) do not drop below minimum distances.

The moment at which a book block arrives at the conveyor belt of the three-knife trimmer is detected by means of a sensor. If the spacing between the book blocks is now greater than the minimum distance, the speed of the translational movements of the three-knife trimmer is reduced by the controller, after which the three-knife trimmer is synchronised with the cycle of the supplied book block. If the distance exceeds a maximum value, the controller is programmed to be able to generate empty cycles on the three-knife trimmer.

The book blocks A″ are oriented at the head side or foot side by a fixed stop on the conveyor belt 110. This can be carried out by a transport section having slightly skew transport rollers, or by other methods known from the prior art.

The other modules of the three-knife trimmer according to the indications in FIGS. 2 and 3 are described in detail in the following figures.

A leveller slide 125 (see FIGS. 3 and 14) is operatively connected to the insertion wheel 120 (feed apparatus) and is intended to be used in addition to the measures explained above to ensure secure positioning of the book block with respect to the stop surfaces thereof.

With both individual book blocks and a stack of booklets, a stop surface is taken as the basis for the orientation according to the spine side of the printed products with respect to a fixed bearing surface inside the insertion wheel 120. On the other hand, it has to be ensured that, prior to the first cutting operation, the printed products have a corresponding suspended oblong position in the flow direction at the head side and/or the foot side.

In the case of book blocks, this takes place in that the individual book is taken, according to the format, from the insertion wheel 120 by the transport clamping apparatus 130 in a manner controlled by a sensor, which operates on the outer edge of the overhanging cover or of the book block itself in the region of the head part or foot part, respectively. This ensures that the edge zone cut off at that point on the book block has a coordinated size.

In the case of a stacked bundle of individual booklets, lateral means that ensure uniform orientation of the cutting-location-side edges of said bundle should preferably be provided before the first cutting operation.

The insertion wheel 120 thus operates by a hinged, rake-like guide pivoting against the book block so that, following a 90° rotation, said block, now resting on its spine, cannot fan out or tip over. The rake-like guide is coupled to the clamping assembly, which briefly clamps the book block in a position resting on the spine and is kinematically designed such that said rake-like guide can be transferred into a position dependent on the book thickness. Subsequently, the clamping assembly opens again slightly so that the book block can orient itself, as a result of gravity, on its book block spine side against the stop surface of the insertion wheel. The clamping assembly then closes again, after which the book block is held in a defined position.

This approach, which is optimised per se, thus ensures that the spine side of the book block assumes a defined position that is critical for the subsequent cutting operations.

Nevertheless, for reasons of quality it is appropriate to provide additional measures that are intended to intervene in those cases where it is not sufficient, when the book blocks, in particular the book block spines thereof, have different designs, to use gravity components alone to guarantee the desired defined position of the book block spine side with respect to the associated stop surface.

In this context, it must be assumed that the book blocks are in most cases configured to have a cover that has a relatively large overhang on all sides (head, foot, front part) with respect to the original book block body. This overhang in principle does not restrict the cutting process in any way, yet provides logistical advantages owing to standardisation since a wide spectrum of different book block formats can be gripped by the same cover size. It can also be assumed that the relatively large overhang is used in the majority of cases.

To achieve the secure defined position between the book block spine side and stop surface within the insertion wheel 120 even in the case of covers having a large overhang in the region of the head, foot and front parts, in order for the invention to make a contribution over the prior art it is proposed that, during the brief time the clamping assembly is open to allow for the effect of gravity on the printed product, at least one suitably formed leveller slide 125, 126 (see FIGS. 14 and 15) is used, which can directly or indirectly exert the necessary contact pressure on the book block by means of the cover overhangs so that the book block spine side rests securely on the associated stop surface or is oriented from the side.

For this purpose, the two front cover overhangs of the book block are gripped by brush combs (see FIGS. 14 and 15) oriented at an optimum angle in the pressing plane or by other flexible mechanically or pneumatically actuated means, so the resultant contact pressure is transmitted to the body of the book block A by means of cover overhangs in such a manner that said book block then rests securely on the stop surface arranged within the insertion wheel 120, or is otherwise positioned horizontally.

With the example of a brush comb (see FIGS. 14 and 15), the material flexibility thereof is achieved in such a way that the resulting free portion of the brush comb between the two cover overhangs can additionally advance as far as to the front part of the book block as a result of the vertical or semi-vertical pressing movement, in order to be able to exert an additional or predominant contact pressure at that point.

In principle, this contact pressure can also be provided when a lateral contact pressure has to be generally exerted on the head part or foot part of the printed product by suitable means in the form of an additional leveller slide 126 (see FIGS. 3 and 15), with the aim of bringing about the creation of a uniform plane over all the printed products of the bundle so that said edge can then be reliably detected by a sensor so as to be able to produce said optimum position within the transport clamping apparatus 130 to allow the subsequent cutting operations (head and foot) to be carried out to the correct size.

Figure 4:
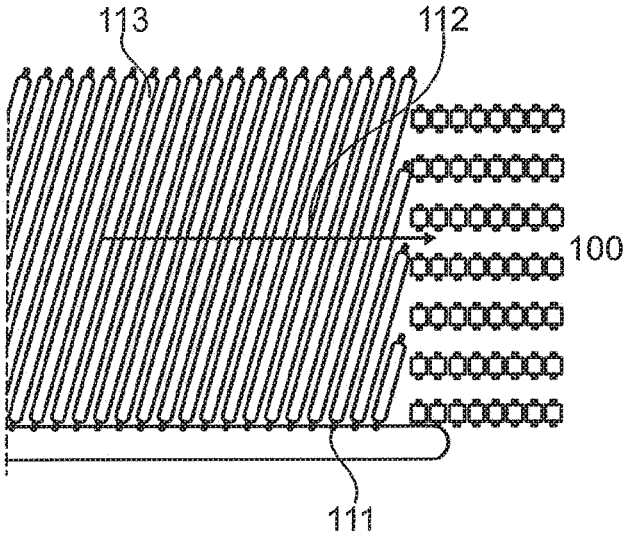
FIG. 4 shows an input apparatus for the book blocks into the three-knife trimmer.

As can be seen from FIG. 4 in this respect, the book blocks are pressed against a fixed stop 111 by transport rollers 113 that are slightly skew in the transport direction 112, and then moved on to the three-knife trimmer 100. The fixed stop 111 can be in the form of a following drive belt or simply as a fixed plate.

The book blocks A″ then reach a transition position, from which they are raised for example by a rotating insertion wheel 120 and moved into position as a result of rotation.

Figure 5:
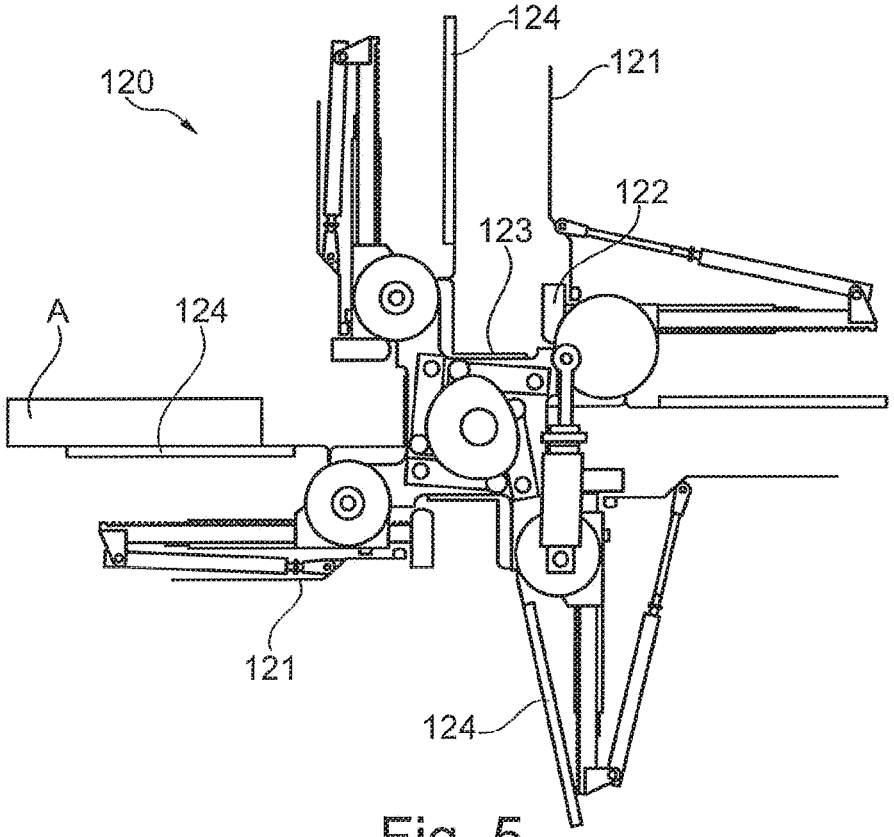
FIG. 5 shows an insertion wheel as a feed apparatus.

As can be seen from FIG. 5 in this respect, during a first 90° rotation of the insertion wheel 120 that fulfils the function of a feed apparatus with respect to a subsequent operation, a hinged rake-like guide 121 pivots against the book block A so that, following the 90° rotation, the book block, now resting on the spine, cannot fan out or tip over. The rake-like guide 121 is coupled to a clamping assembly 122, which briefly clamps the book block in a position resting on the spine and is kinematically designed such that the rake-like guide 121 can be transferred into a position dependent on the book thickness. Subsequently, the clamping assembly 122 opens again slightly so that the book block A can orient itself, as a result of gravity, on its book block spine against the stop surface 123 of the insertion wheel 120. The clamping assembly 122 then closes again, after which the book block is firmly held in a defined position. The four-part insertion wheel 120 now rotates further by two 90° cycles in each case and generally provides the printed product, in a now suspended position, for the subsequent processing. During this rotational movement, the first rake-like guide 121 and a second rake-like guide 124 operatively connected thereto are pivoted slightly away from the book block so that the pages of the book block hang vertically downwards as a result of gravity alone, while the book block is held on its book block spine by the clamping assembly 122.

In this position, an open transport clamp (easily visible in FIG. 2, reference numeral 130) travels horizontally over the book block towards the book block spine and takes said book block over a large surface area thereof.

Figure 6:
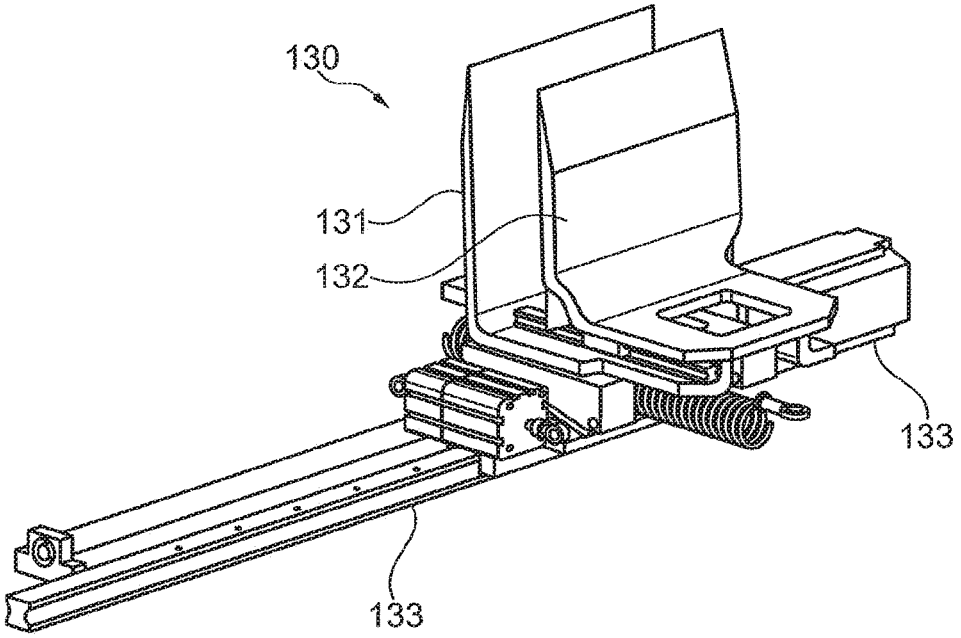
FIG. 6 shows a transport clamp.

As can be seen in this respect in detail from FIG. 6, said transport clamp 130 consists of two clamping jaws 131, 132. Preferably, the transport clamp operates such that one clamping jaw 131 does not perform any stroke while the other clamping jaw 132 carries out the entire stroke. Together, the two clamping jaws 131, 132 cover two different offsets, which depend on whether the printed product is being transported generally or an empty journey is being made. Optionally, in the case of particular variable and/or inconsistent book block thicknesses, the stroke of the two clamping jaws 131, 132 of the transport clamp 130 can be designed individually, so the same or different paths are covered until the final pressing position is implemented.

The transport clamp 130 can be moved horizontally by a linear movement apparatus 133. A controlled drive moves the transport clamp 130 precisely with respect to a take-over position in line with the book block. In this case, said take-over position is always dependent on the portion to be trimmed off at the head side or foot side of the book block. When in the take-over position, the transport clamp 130 thus closes and in the process clamps the book block over a large surface area between the front and rear faces thereof. Only the spine region and the region of the book block to be trimmed off are left free in each case. In this regard, reference is made to the description of FIG. 12.

The clamping assembly 122 (see FIG. 5) now opens and releases the book block spine. After that, the transport clamp 130 moves horizontally and transports the book block into the first cutting position (see also FIG. 1, reference numeral 1) of a modular multiblade apparatus.

The two clamping jaws 131, 132 can also be operated according to the following criteria: Each clamping jaw is directly or indirectly operatively connected to a drive that operates to bring about the frictional clamping effect. The clamping jaws guided by the drives comprise adjustable and/or prediction-controlled stroke and frictional-connection profiles geared towards any format shape of the printed product present, so the frictional gripping of the printed product carried out by the clamping jaws is designed to be symmetrical or semi-symmetrical with respect to the centre line of said product. At least during the operative phase for exerting the clamping effect on the printed product, the clamping jaws perform a mutually coordinated uniform, non-uniform or adaptive speed profile. This operation can be provided for all the operatively interconnected clamping jaws that form part of this application.

Figure 7:
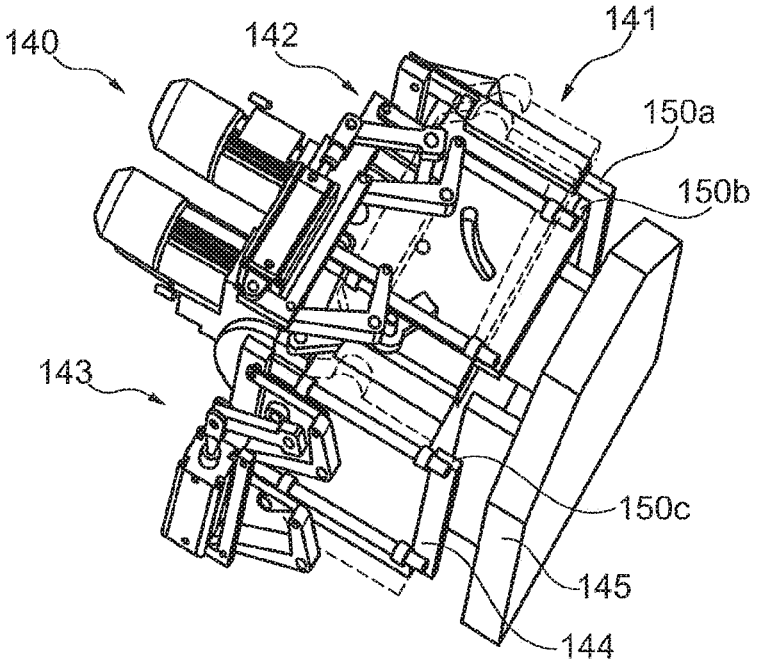
FIG. 7 shows a modular cutting apparatus containing the three cutting stations.

As can be seen in this respect from FIG. 7, the modular cutting apparatus 140 comprises three cutting stations, consisting of a first station 141 at the cutting location 1 (see FIG. 1), a second station 142 at the cutting location 2 (see FIG. 1) and a third station 143 at the cutting location 3 (see FIG. 1). For the particular cutting operation, the book block is pressed by a pressure plate 145 and additionally by a pressure beam 144 in such a manner that, during the cutting operation, the book block is clamped and pressed to a maximum in the region between the transport clamp and the cutting edge by pressure beams 144 and the aforementioned pressure plates, respectively. A blade 150*b* preferably moves in an oblique cut towards a cutting bar, which in itself is stationary.

The other two cutting locations are worked by the blades 150*a* and 150*c*, which follow substantially the same pressing and cutting philosophy. In the first cutting station 141, the head region of the book block is cut (see also FIG. 1). However, the possibility of starting the first cutting operation with the foot region of the book block is not excluded, although with some configurations this would require an adjustment to the active location of the clamp and, if need be, of the cutting apparatus 140 and the width of the cut-offs, based on the clamping on the book spine side $A^R$ being maintained (see FIG. 1).

Referring back to FIGS. 1, 2 and 3, during the cutting operation in both the vertical (Y-plane, see FIG. 1) and the horizontal direction (X-plane, see FIG. 1), a movable, open first gripper 103 intervenes, the gripper being directed towards the book block spine in the vertical direction. Following the first cut, the first gripper 103 takes the book block by the spine and the transport clamp 130 opens. Subsequently, said transport clamp travels into the take-over position for the next book block. The first gripper 103 transports the book block vertically upwards (Y-plane) from said first cutting operation (FIG. 1, reference numeral 1) and in the process travels through a superimposed, horizontal movement into the second cutting position (FIG. 1, reference numeral 2).

The movement path of the first gripper 103 in the vertical direction is controlled by the machine controller according to the width of the cut book block, it also being possible for the movement path of the gripper to be independently controlled in general in the horizontal direction with respect to the book block, for instance when a specific gripping position is desired. For example, when the format and the portions to be trimmed off in each book block necessitate an asymmetrical or semi-asymmetrical clamping effect or a one-sided clamping effect dependent on the centre of gravity.

In the second cutting position (FIG. 1, reference numeral 2), the book block is by a plurality of pressure bars, which into a pressure bar group (FIGS. 2 and 3, reference numeral 200), by means of which bars the book blocks are clamped between the front page and the back page. In FIG. 2, the pressure bar group is shown in the closed state, while the pressure bar group in FIG. 3 is shown in an open state.

Figure 8:
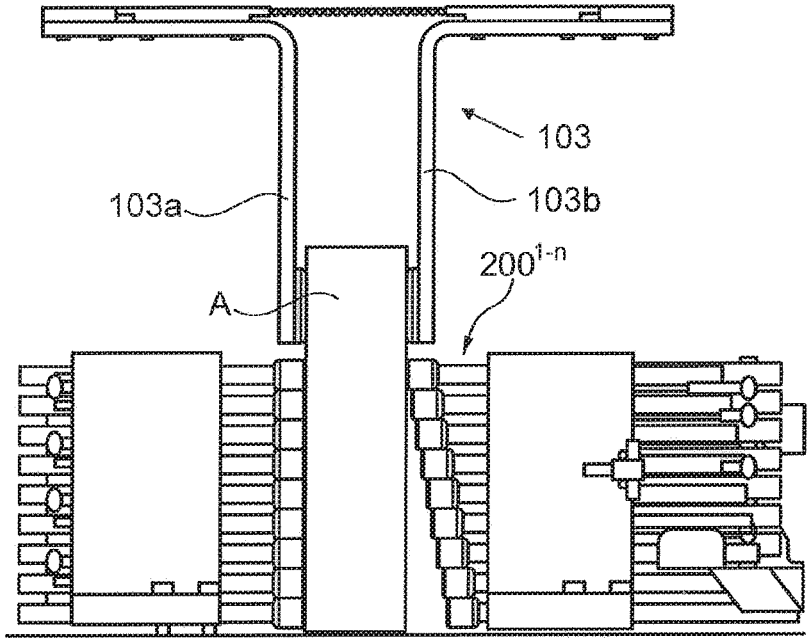
FIG. 8 is an illustration during operation of the pressure bars.
Figure 9:
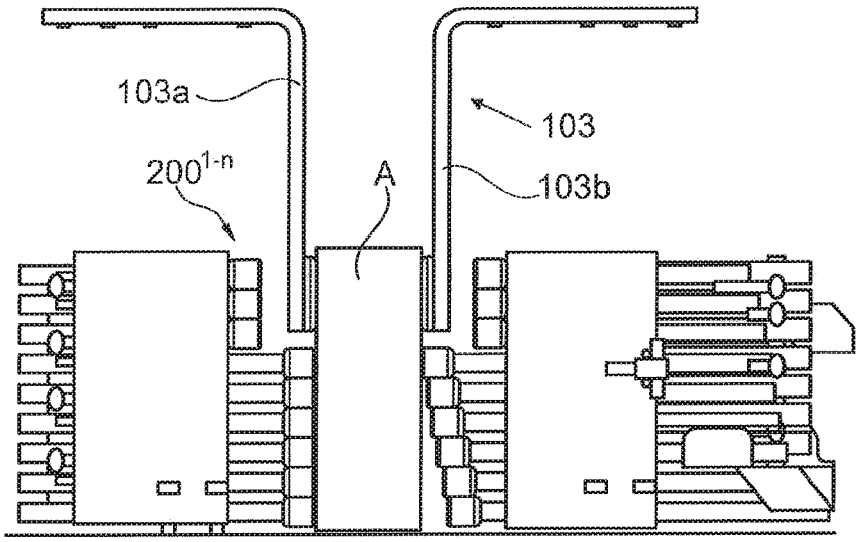
FIG. 9 is an additional illustration during operation of the pressure bars.

As can be seen in FIGS. 8 and 9, the individual pressure bars $\mathbf{200}^{1\text{-}n}$ close one after the other, starting from the book spine, so that the air between the individual sheets can be pressed out in a targeted manner towards the cut edge, which also smoothes the printed product as a whole at the same time. As can then be seen clearly from FIG. 9, the number of pressure bars that close is only ever the number for which there is space between the position of the gripper 103 having the respective clamping jaws 103*a*, 103*b*, and the second cutting station 142 at the second cutting location 2 (see FIG. 1). The same clamping jaws 104*a* and 104*b* are associated with the other gripper 104 (see FIG. 1). Therefore, the book block is again pressed over a large surface area. In the second cutting station 142, the front side of the book block is now cut, similarly to the manner in the first and third cutting stations 141, 143 for the head and foot side, respectively.

Figure 10:
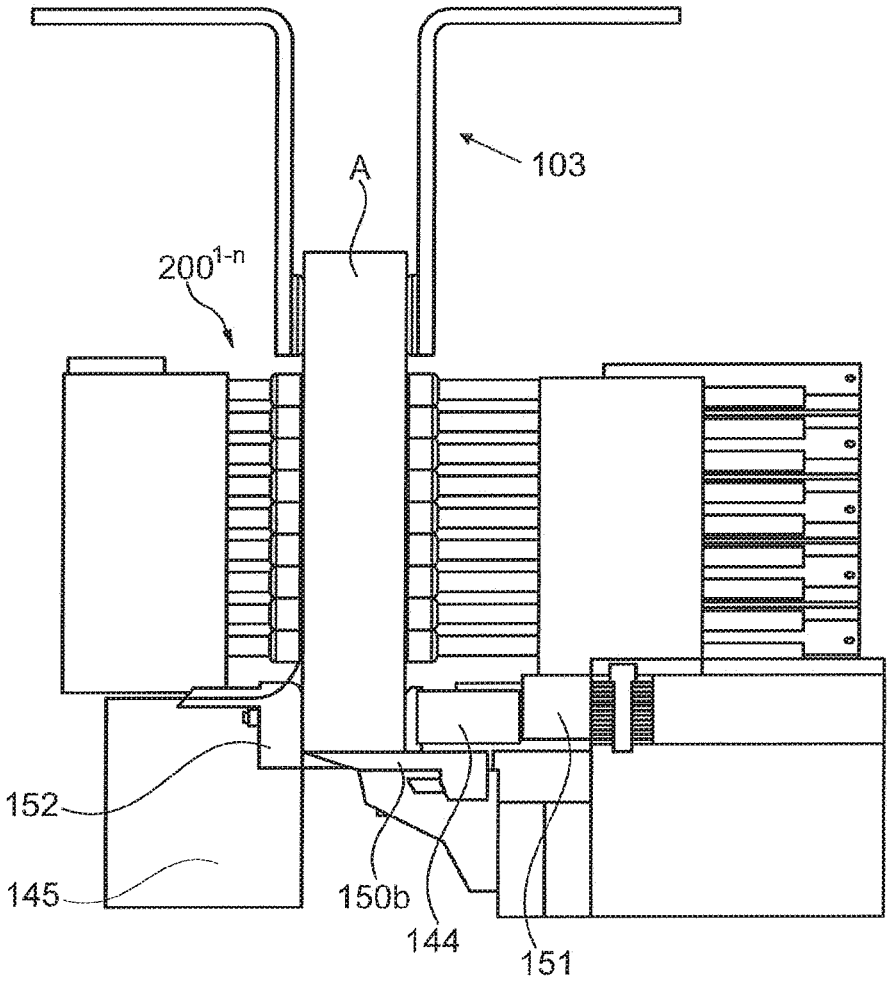
FIG. 10 is an additional illustration during the cutting operation.

Once the pressure bars $\mathbf{200}^{1-n}$ that are being used from the pressure bar group 200 have clamped the particular book block at the second cutting location 2 (see FIG. 1, reference numeral 2), as can be seen in FIG. 10, the first gripper 103 can release the book block and be moved back into its take-over position (cutting location 1, FIG. 1) for the next book block.

Furthermore, FIG. 10 shows the final force-based retention of the book block A during the cutting operation, for ensuring that the cut can be performed to a high quality by the blade 150*b* shown. Thus, when the pressure bars $\mathbf{200}^{1-n}$ being used (see FIGS. 8 and 9) have taken the book block A from the gripper 103, pressure beams (reference numeral 144) that exert the definitive contact pressure on the book block in the direct cutting region come into action. In the process, this force has to be designed to be predominantly counter to the contact pressure exerted by the pressure bars so that the cut carried out by the blade 150*b* allows for a rectangular, sharp cut edge. The pressure device consists of an immovable stop 152 as a component of a pressure plate 145 (see also FIG. 7) on one side of the book block, and of an opposite, movable pressure beam 144 on the other side, which beam is pressed against the book block by a clamping bolt 151.

In a further embodiment, the stop 152 can also be designed to be movable in order to take account of the thickness and/or thickness consistency of each book block let in from above—in other words, so that the leading edges of the inserted book block cannot push up. The stop 152 can be dynamically adjusted in this manner by the above-mentioned machine controller.

The clamping bolt 151 for the pressure beam 144 can, for example, be driven by a motor or hydraulically or pneumatically, and thus exert the preset pressure force on the book block.

The other pressure beams (see FIG. 7, reference numeral 144) at the other cutting locations 1, 3, which now provide the pressure force exertion in the vertical plane, also function following the same principle. The aim here too is to ensure a rectangular, sharp cut edge.

As soon as the book block is cleanly held by the pressure bars $\mathbf{200}^{1-n}$, the second cutting operation (front cut) can be carried out. Following the end of the cutting operation, a second gripper 104 (see FIG. 1) travels into the position above the pressure bar group and grips the book block in a similar manner to the first gripper 103. In the process, the position of the second gripper 104, in which it clamps the book block, is dependent on the cut book block height. The controller brings the second gripper 104 into the pre-calculated gripping position, so that the correct book block height is produced by the third cutting operation (see FIG. 1, reference numeral 3) on the book block.

Once the second cutting operation (front cut) is complete, the pressure bar group 200 opens and the second gripper 104 moves the printed product further into the cutting position for the third trimming (foot part), by means of a vertical movement (from the cutting position), then a horizontal movement (supply to the next cutting position), and finally another vertical movement (see FIGS. 1 and 2).

During the vertical movements in the region of at least one cutting position, the particular loaded gripper performs another lateral offset movement, as required, with respect to a clamping surface of the clamping apparatus.

Figure 11:
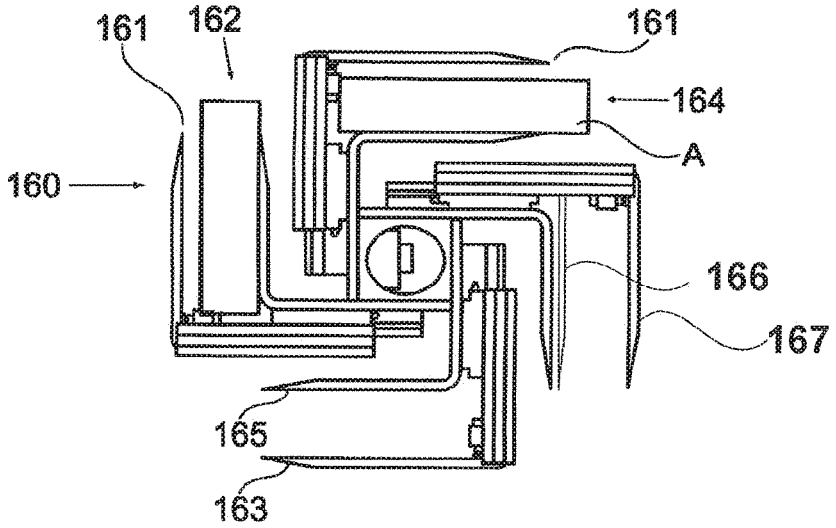
FIG. 11 shows a rotatable four-clamp system as a clamping apparatus and removal apparatus.

When the cutting operation at the third cutting location 3 (see FIG. 1) is complete, the rotatable removal apparatus (four-clamp system) 160 according to FIG. 11, and thus also the clamp 161, moves away from the blade together with the book block orthogonally to the blade movement. The rotatable four-clamp system 160 rotates by 90° during each cycle.

In this context, the four-clamp system 160 shown in FIG. 11 shows the position of the clamp 161 in the cutting position 162, in which a movable jaw 163 is still open. Another clamp operates within the removal position 164. In this position, the book block A can be removed. The mode of operation of the four-clamp system 160 ensures that, during the cutting process at the third cutting location 3 (see FIGS. 1 and 7) and the rotational movement of the four-clamp system, the book block A is pressed for a sustained period of time between the movable jaw 163 and the stationary jaw 165. Furthermore, two states of the clamp 161 can be seen within one quadrant, namely a completely closed position 166 and a completely open, intermediate position 167. One variant or another within said quadrant can be specifically considered, depending on the spatial conditions present in each case during the rotation.

A removal apparatus can be, for example, a conveyor belt that is equipped for conveying the book block by means of movable rollers. Other devices known from the prior art can also be provided.

Figure 12:
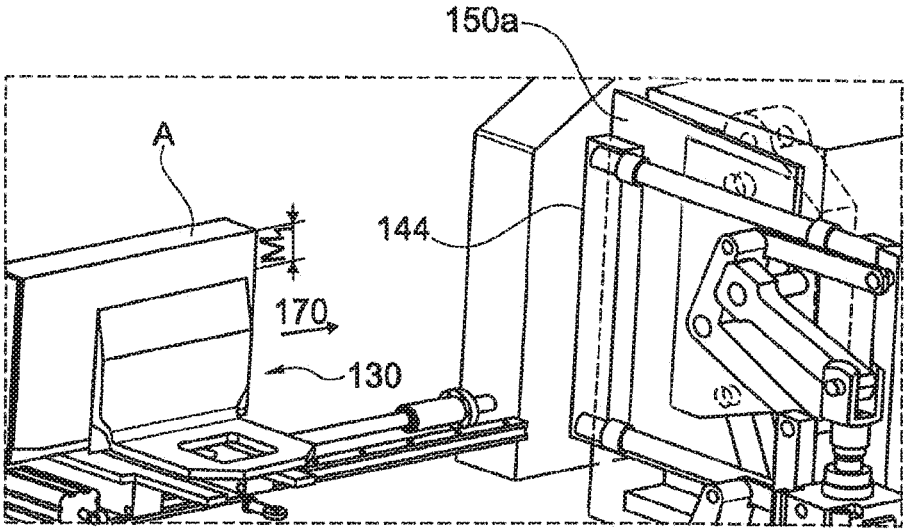
FIG. 12 shows the overall pressing of the book block during the cutting operation.

FIG. 12 shows the overall pressing of the book block by means of pressure beams 144 during the cutting operation. In terms of the action, pressing of this type corresponds to that described in relation to FIG. 10. The feed direction is shown by reference numeral 170.

Figure 13:
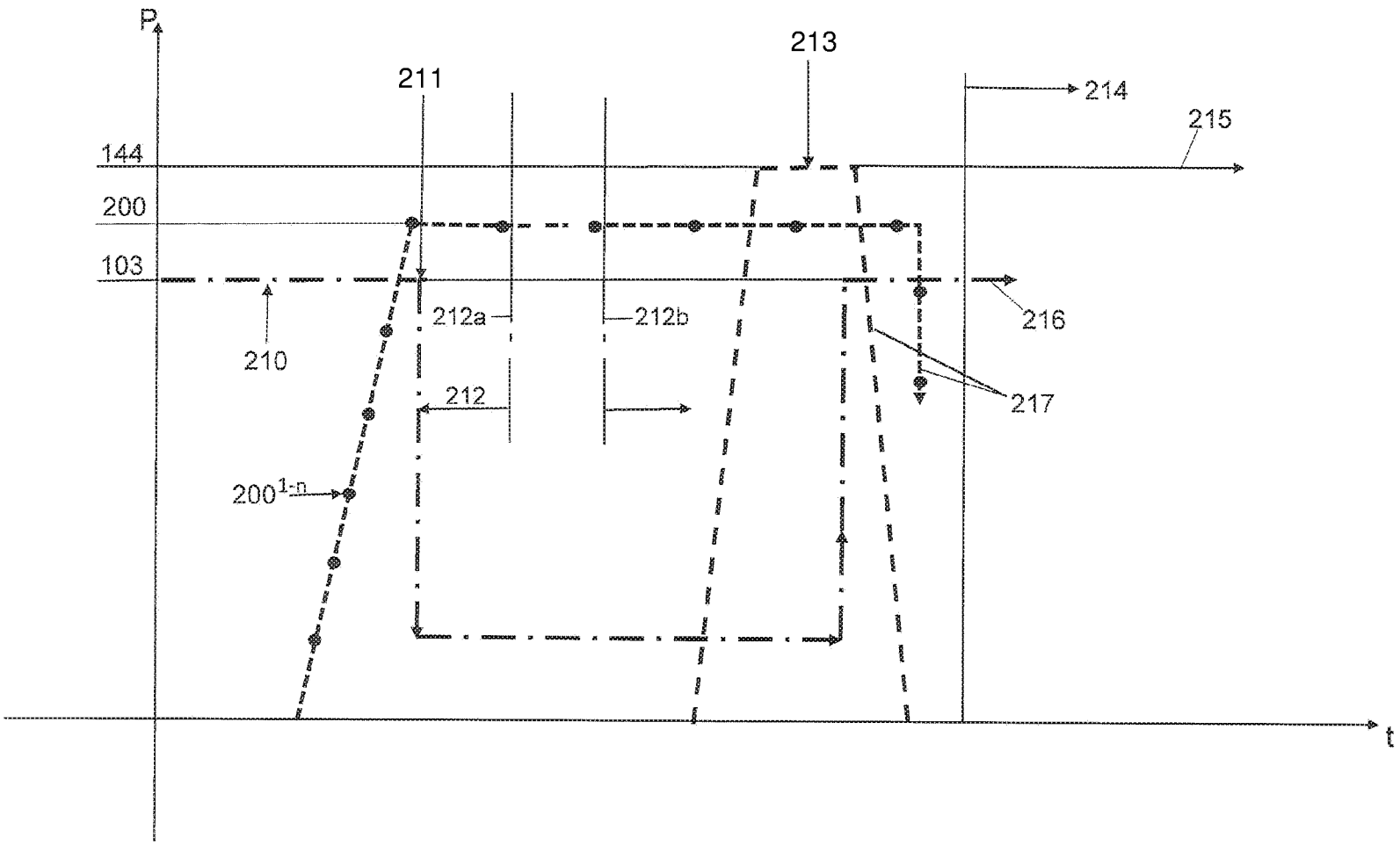
FIG. 13 shows the course of the force application of various clamping elements during a cutting operation.

FIG. 13 shows the interdependence of the various pressing elements (clamping apparatuses) on the printed product, which interdependence is applied, based on the cutting location 2, by the various clamping apparatuses 103, 200, 144, the one clamping apparatus 200 at this cutting location consisting of a pressure bar group 200. The clamping forces of the various clamping apparatuses in the graph should also only be understood in terms of quality. The clamping force of the gripper 103 that is provided for the transport 210 of the printed product from one cutting location to the next is in itself smaller than the cutting location-based clamping forces 200 and 144, since the force in this case is merely one that has to be sufficient for the secure clamping effect of the printed product during the transport. At the cutting location 2, the clamping force of the pressure bars $\mathbf{200}^{1-n}$ belonging to the pressure bar group then quickly rises simultaneously or one after the other, so that the contact pressure of the gripper 103 drops 211 immediately (drop point) as soon as the final clamping force of the pressure bars on the printed product is achieved. The scope in which the contact pressure of the gripper on the printed product drops is set in each individual case and also depends on the weight of the printed product in question. The final clamping force on the printed product, which is important for the qualitative cut quality, is then exerted by the above-mentioned pressure beam 144, which assumes its position fully parallel with regard to the plane of the cutting blade. As can be seen from the force graph according to FIG. 13, the pressure beam 144 preferably applies the largest clamping force, which takes place in a variable and phase-shifted 212 manner (intervention plane) with respect to the other clamping apparatuses, as shown by the parallel broken lines 212*a*, 212*b* (phase shift interval). As soon as the pressure force from the pressure beam 144 is applied, the blade carries out the cutting operation 213. Subsequently, the pressure beam 144 remains in the cutting plane 215 for a brief period, until the contact pressure of the gripper has risen to such an extent that reliable further transport 214 of the printed product is ensured. Afterwards, the clamping forces of the other elements 144, 200 decrease according to a particular reduction curve 217, such that the further transport plane 216 containing the printed product that is gripped completely by the gripper 103 is open again.

In principle, this dynamics also applies to the gripper 104 belonging to the second support 102 (see FIG. 1) in operative connection with the respective clamping apparatuses.

Figure 14:
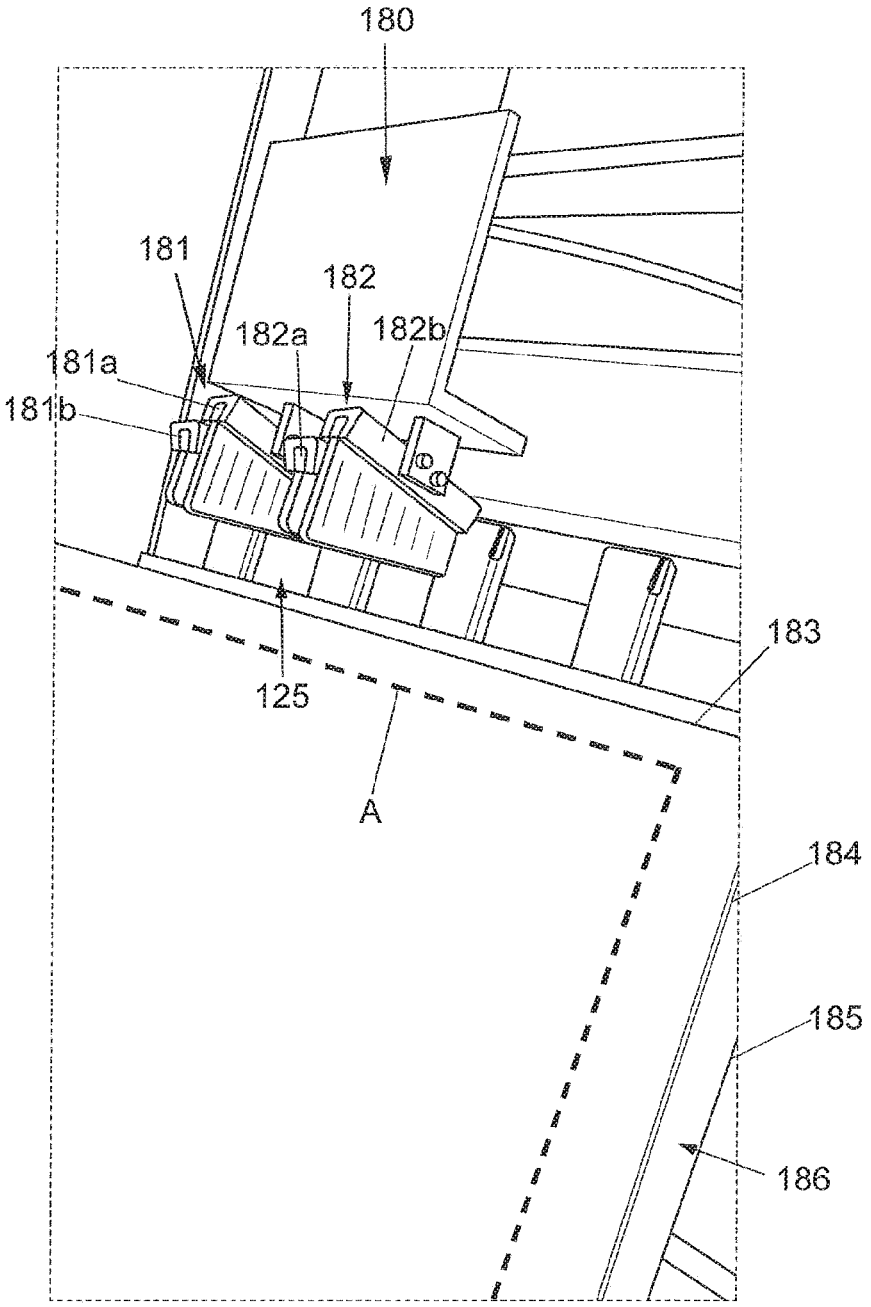
FIG. 14 shows a leveller slide for the vertical force exertion on the printed product.

FIG. 14 shows the configuration of a leveller slide 125 (see also FIG. 3). Said slide consists of a receiving plate 180 which acts from above and carries brush bodies 181, 182 on the printed product side, which bodies exert a pressure on the front cover ends 183 that protrude beyond the printed product A, so that the spine of the printed product is in line with the bearing surface within the insertion wheel 120. Since the cover ends 184 are located on the front in the same alignment plane, they can be better seen in positions 185 and 186 (head side or foot side of the printed product A). The two brush bodies 181 and 182 each consist of two sub brush bodies 181*a*, 181*b*; 182*a*, 182*b*, which are at such an angle to one another that the particular cover end is gripped in a cuneiform manner and can accordingly be pressed downwards in parallel, whereby the cover ends do not undergo any damaging arching.

Figure 15:
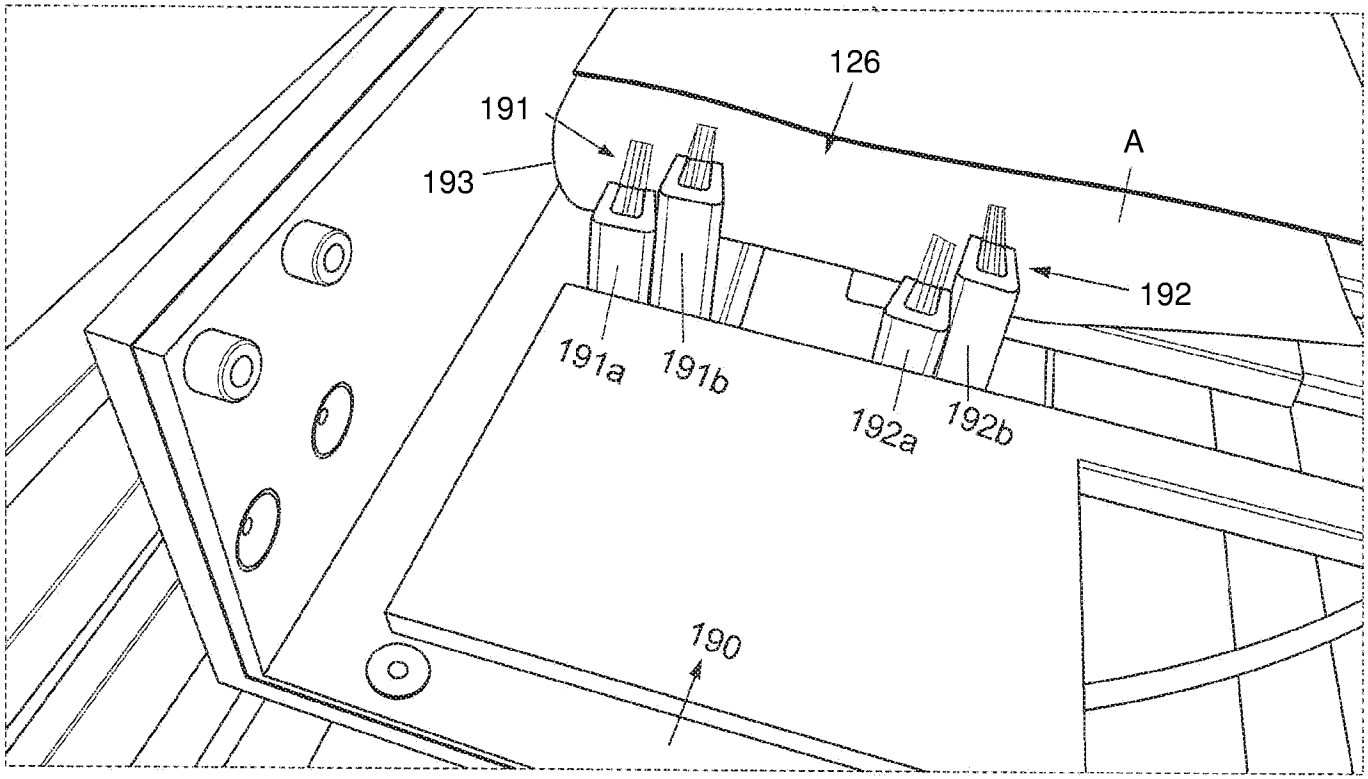
FIG. 15 shows a leveller slide for the horizontal force exertion on the printed product.

FIG. 15 shows the configuration of another leveller slide 126 (see also FIG. 3). Said slide consists of a receiving plate 190 that acts from the side (head side or foot side) and carries brush bodies 191, 192 on the printed product side, which bodies exert a pressure on the head-side or foot-side cover ends 184, 185 that protrude beyond the printed product A, so that the printed product A is positioned accordingly for the cutting operations. In this case, the overhanging cover ends are visible in relation to the spine part 193 of the printed product A. The two brush bodies 191 and 192 each consist of two sub brush bodies 191*a*, 191*b*; 192*a*, 192*b*, which are at such an angle to one another that the particular cover end is gripped in a cuneiform manner by the brush bodies and the entire printed-product body can be positioned according to requirements, whereby the cover ends do not undergo any damaging arching.

The described three-knife trimmer 100 according to the invention and the operation thereof have the following advantages over the known three-knife trimmers:

During cutting, the book block is pressed over almost its entire surface area in clamps or in the pressure bar group. The book block only has a free surface $M_1$ in a region of the book spine. This is unimportant because the binding holds the book block together sufficiently in this region and the pressure bars support the book block in the cutting region within the particular cutting station of the cutting apparatuses. Pressing the book block over the entire surface area leads to a high cut quality.

The pressing over the entire surface area is achieved in a simple manner. There is no need to move any ribs, supporting elements or support bars according to the format. As a result, a high cycle count and thus high output of the three-knife trimmer can be achieved.

Since the book block is transported in a suspended manner to the individual cutting stations 141, 142, 143 (FIG. 7) by the three-knife trimmer according to the invention and the operation thereof, there is no need to provide any support for the pages of the book block at the transition points in the transport system. Since the book blocks are not transported horizontally, the pages of the book do not sag between the bearing points if the bearing surfaces are not over the entire surface area, because they cannot become caught at the transition points.

The three cutting stations 141, 142, 143 of the cutting apparatus are arranged in a U-shape with the open side of the U arranged downwards with respect to one another. The trimming of the portion on the book block is carried out in all three cutting operations against the inside of the U-shape, in operative connection with the pressure beams 144 (see FIG. 7, and in particular FIG. 10). As a result, it is possible to successfully "convey away" all three trimmed-off portions using a single cut-off removal device arranged there below. In particular, said cut-offs fall downwards as a result of gravity without any auxiliary means.

Effective removal of cut-offs, regardless of whether the products are book blocks or booklets, is therefore very important because, in industrial production of individual books, the different formats are very often produced first at the three-knife trimmer. In the process, the book blocks are supplied to the three-knife trimmer at a size that is tailored towards the largest final format, which leads to large cut-offs in the case of small final formats.

In three-knife trimmers having cutting cartridges and press rams, it is common to orient the book block from the book spine towards the head side and from the book spine towards the foot side by means of two rectangular stops in the corners, and from the book block front side by one stop. In the production of books, booklets, etc. having variable formats, covers of the same format are mostly used for a particular format range. If the thickness of the book block now varies and the books are bound by binding machines having fixed-edge processing, the cover at the top side of the book does not protrude to the same extent as at the last page of the book.

If the book block height varies, the cover protrudes from the book to a greater or lesser extent depending on the circumstances. Generally, the book blocks are produced having a fixed projecting length of the cover on one side and a variable projecting length on the other side.

In products of this type, the orientation of the book block is unsuitable, as is the case with three-knife trimmers having cutting cartridges and press rams.

In the three-knife trimmer according to the invention and the operation thereof, the uncut book block or the uncut booklets are oriented at the foot edge or head edge and the processed spine edge. The variable projecting lengths of the cover are therefore not involved in the book block height and the book width.

For each book block to be cut or for each booklet to be cut, the three-knife trimmer controller has to know product data, from which the necessary movements of the transport members can be calculated, so that a cut book is produced at the end having the desired format dimensions.

In this case, these data can be transmitted to the controller in many different ways. A few options are set out below by way of example. Each book block or each booklet is equipped with an identification feature. A feature reader at the input of the three-knife trimmer reads the identification feature (e.g. 1-D or 2-D barcode, RFID chip, label, image, etc.) and transmits the information from the feature to the controller together with the machine cycle assignment. The feature can contain the necessary pieces of information that depict the cut printed product dimensions, or the missing information can be added from a database.

In another system, the book blocks are supplied to the three-knife trimmer in a clocked manner. With each cycle, the three-knife trimmer controller is supplied with the information that is required for cutting the book block to the correct dimension. In this case too, data supplied with the book block can be completed by data from a database.

Another option is that the data containing an order of the book blocks is communicated to the three-knife trimmer before the book blocks are supplied. With each book block that is supplied, the three-knife trimmer processes the next dataset in the predefined order. In the process, the book blocks have to be supplied in the correct order. For monitoring purposes, a feature reader that monitors the order can also be used.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. A method for operating a device for carrying out cutting operations at cutting locations on at least one open format edge of at least one printed product, the cutting operations comprising a first cutting operation, a second cutting operation, and a third cutting operation, the device being operatively connected to a printed product-based feed apparatus for feeding the first cutting operation and operatively connected to a printed product-based removal apparatus which operates on the printed product after the third cutting operation, each of the cutting operations being carried out using at least one cutting apparatus, the method comprising:

transferring the printed product from a first cutting location, at which the first cutting operation for a first format edge of the printed product is carried out, to a second cutting location, at which the cutting operation for the second format edge takes place; and after the second cutting operation is complete at the second cutting location, transferring the printed product to the third cutting location, at which a third cutting operation for a third format edge takes place;

wherein at least one of the transferring the printed product from the first cutting location to the second cutting location or the transferring the printed product from the second cutting location to the third cutting location is performed by at least one transport unit, the transport unit comprising at least one gripper that grips the printed product by its spine in order to convey the printed product in a suspended manner, wherein a plurality of pressure forces act on the printed product at each of the cutting locations prior, during, or following a respective one of the cutting operations, the pressure forces comprising:

a) a first pressure force on the printed product being exerted by at least one clamping jaw of the gripper in order for the gripper to grip the printed product by the spine in a suspended manner prior to the respective one of the cutting operations;

b) a second pressure force on the printed product being exerted by at least one first clamping apparatus, the second pressure force acting on the printed product to hold the printed product in a stationary manner during the respective one of the cutting operations;

c) a third pressure force on the printed product being exerted by at least one second clamping apparatus, the third pressure force acting on the printed product at a cutting region adjacent to a blade during the respective one of the cutting operations, and wherein, the first clamping apparatus, of at least the second cutting location, comprises individual pressure bars, and when the pressure bars carry out a pressing movement onto the printed product, the pressing movement thereof begins with a first pressure bar of the individual pressure bars in a spine region of the printed product, then proceeds with successive pressure bars in an order toward a plane of an edge of the printed product to be cut.

2. The method according to claim 1, wherein the printed product to be trimmed comprises a bound book block, individual booklets, or a number of stacked booklets.

3. The method according to claim 1, wherein the cutting apparatus of each of the cutting operations is operatively connected in each case to a corresponding one of the at least one gripper, wherein the corresponding gripper is movable in three orthogonal planes in a translational manner, the movement of the corresponding gripper in a vertical plane being controlled according to a width of the printed product after trimming, and the movement of the corresponding gripper being independently controlled in a horizontal plane with respect to the book block in order to grip the printed product at a location according to portions of the printed product to be trimmed, and wherein the method further comprises:

exerting, by the corresponding gripper, the first pressure force on the printed product to be trimmed, the corresponding gripper having single-action or multi-action controllable pressure surfaces that belong to the clamping jaw, and the controllable pressure surfaces of the gripper being controllably positioned to correspond to the format size of the printed product prior to, or is adjusted during operation of, the method in order to correspond to the format size of the printed product.

4. The method according to claim 3, wherein the first edge to be trimmed at the first cutting location is the head part, the second edge to be trimmed at the second cutting location is the front part, and the third edge to be trimmed at the third cutting location is the foot part of the printed product, or wherein the first edge to be trimmed at the first cutting location is the foot part, the second edge to be trimmed at the second cutting location is the front part, and the third edge to be trimmed at the third cutting location is the head part of the printed product.

5. The method according to claim 3, wherein the feed apparatus for the positional orientation of a printed product formed as a book block is in the form of a multi-part insertion wheel that is operated according to the following criteria:

a) during a first 90° rotation of the insertion wheel, a hinged rake-like guide performs a pivot movement against the book block in such a manner that, following the 90° rotation, the book block is positioned on the spine, whereby it is protected against fanning out and/or tipping over;

b) the rake-like guide is coupled to a clamping assembly, by which the book block is briefly clamped in a position resting on the spine, said clamping assembly being kinematically operated such that the rake-like guide is transferred into a position dependent on the book block thickness;

c) afterwards, the clamping assembly opens again slightly so that the book block spine orients itself, as a result of gravity, according to a stop surface within the insertion wheel;

d) next, the clamping assembly closes again, after which the book block is in a defined position;

e) the insertion wheel then rotates further by two 90° cycles in each case and transfers the book block into a now suspended position with respect to the cutting locations;

f) during this latter rotational movement, the first rake-like guide and an operatively connected second guide are pivoted away from the book block, the book block being held in the region of at least a part of its spine by the clamping assembly, while the part of the book block released by the guides hangs vertically downwards as a result of gravity alone.

6. The method according to claim 5, wherein, when the clamping assembly is open, an additional device acts from above and/or from the side and exerts a brief pressure either directly or indirectly on book blocks in order to ensure the end position thereof with respect to either the stop surface or a predetermined position in the horizontal direction.

7. The method according to claim 3, wherein the feed apparatus for printed products, which consist of at least one booklet, is in the form of a multi-part insertion wheel that is operated according to the following criteria:

a) during a first 90° rotation of the insertion wheel, a hinged rake-like guide performs a pivot movement against the booklet in such a manner that, following the 90° rotation, the booklet is positioned on the spine, whereby it is protected against fanning out and/or tipping over;

b) the rake-like guide is coupled to a clamping assembly, by which the booklet is briefly clamped in a position resting on the spine, said clamping assembly being kinematically operated such that the rake-like guide is transferred into a position dependent on the book block thickness;

c) afterwards, the clamping assembly opens again slightly so that the booklet spine is oriented, as a result of gravity, according to a stop surface within the insertion wheel;

d) next, the clamping assembly closes again, after which the booklet is in a defined position;

e) the insertion wheel then rotates further by two 90° cycles in each case and transfers the booklet into a now suspended position with respect to the cutting locations;

f) during this rotational movement, the first rake-like guide and an operatively connected second guide are pivoted away from the booklet, the booklet being held in the region of at least a part of its spine by the clamping assembly, while the part of the booklet released by the guides hangs vertically downwards as a result of gravity alone.

8. The method according to claim 3, wherein the feed apparatus is operatively connected, in the region of the first cutting location, to a movable clamping apparatus that is equipped with clamping plates and takes the printed product from the feed apparatus, after which the printed product is supplied to the first cutting operation.

9. The method according to claim 3, wherein the transport unit consists substantially of two printed product-based supports that each have a gripper, the grippers grip the spine of the printed product to be trimmed, the two supports/grippers are operatively interconnected, and the supports/grippers are based on the following controller-assisted translational movements with respect to the cutting locations:

a) the first gripper of the first support takes the printed product once the first cutting operation is complete at the first cutting location;

b) the first support then travels together with said printed product to the second cutting location, where it positions the printed product for the second cutting operation to be carried out, and then travels back empty to the first cutting location, where a new printed product that has been brought subsequently and already processed at said cutting location is taken;

c) in the meantime, the second support/gripper takes the printed product at the second cutting location immediately after the completed cutting operation at said location, and transfers it to the third cutting location, where the third cutting operation is carried out;

d) afterwards, the second support/gripper returns empty to the second cutting location, where a subsequently brought, trimmed printed product is present, after which the second support/gripper travels again, together with said printed product, to the third cutting location at which the third cutting operation is carried out.

10. The method according to claim 3, wherein grippers are equipped on their ends with clamping jaws that act on the printed product, and wherein, prior to and/or following the cutting operation, at least one gripper loaded with a printed product in the region of at least one cutting location performs at least one specific lateral offset movement with respect to a pressure surface of at least one local clamping apparatus.

11. The method according to claim 3, wherein each printed product is gripped by clamping jaws of a gripper symmetrically, asymmetrically or to a maximum at its centre of gravity and/or according to the lengths of the edges to be trimmed off.

12. The method according to claim 3, wherein at least one gripper carries out a further, positioning movement in at least one plane with respect to a stationary pressure surface of a clamping apparatus at least one cutting location prior to and/or following each cutting operation.

13. The method according to claim 3, wherein the removal apparatus operates at the third cutting location and is operated according to the following criteria:

a) the removal apparatus is operated by means of a wheel operating in multiple parts;

b) the removal apparatus comprises a clamping apparatus which consists of at least one first jaw and one second jaw, by means of which jaws a clamping effect is exerted on the printed product during the cutting process;

c) following the cutting operation, the multi-part wheel performs a partial rotation, by which the printed product is moved into the ejection position.

14. The method according to claim 3, wherein, prior to and following the cutting operations, at least two of the at least one printed products have different size dimensions with different thickness dimensions.

15. The method according to claim 3, wherein force-exerting, operatively interconnected clamping apparatuses are used at each cutting location, the force-exerting operatively interconnected clamping apparatuses comprising the gripper, the at least one first clamping apparatus, and the at least one second clamping apparatus, and wherein the clamping force exerted by the gripper being smaller compared with the clamping force exerted by the at least one first clamping apparatus used at the first cutting location, which is smaller than the clamping force exerted by at least one second clamping apparatus used at the second cutting location.

16. The method according to claim 3, wherein transport clamping jaws of at least one clamping apparatus move relative to one another according to the following criteria:

a) each transport clamping jaw is directly or indirectly operatively connected to a drive that operates, according to a plurality of control profiles, to bring about a frictional clamping effect, the transport clamping jaws, as guided by the drives, perform adjustable and/or prediction-controlled stroke profiles, of the control profiles, and adjustable and/or prediction controlled frictional-connection profiles, of the control profiles, corresponding to the format shape of the printed product being operated upon;

b) the stroke profiles and frictional-connection profiles performed by the transport clamping jaws result in the transport clamping jaws gripping the printed product such that at least a portion of the printed product is gripped symmetrically with respect to the center line thereof;

c) at least during an operative phase for exerting the clamping force on the printed product, a mutually coordinated uniform, non-uniform or adaptive speed profile, of the control profiles, and/or a movement profile, of the control profiles, is performed by the transport clamping jaws, wherein the control profiles are configured to control the drive.

17. The method according to claim 3, wherein one of the at least one first clamping apparatus acts at the first cutting location, a second one of the at least one first clamping apparatus acts at the second cutting location, and a third one of the at least one first clamping apparatus acts at the third cutting location, and wherein one of the at least one second clamping apparatus acts at the first cutting location, a second one of the at least one second clamping apparatus acts at the second location, and a third one of the at least one second camping apparatus acts at the third cutting location.

18. The method according to claim 3, wherein, in terms of the individual format edges of the printed product, the cutting operation is carried out by an individually operating cutting operation at each cutting location.

19. The method according to claim 18, wherein at least one cutting operation is operated by a single-action cutting blade.

20. The method according to claim 1, wherein, by actuating the pressure bars one after the other starting from the spine of the printed product up to the edge to be cut, air trapped between signatures or pages of the printed product is pressed out.

* * * * *